US011308865B2

(12) United States Patent
Hwang et al.

(10) Patent No.: US 11,308,865 B2
(45) Date of Patent: Apr. 19, 2022

(54) ELECTROLUMINESCENT DISPLAY DEVICE

(71) Applicant: LG Display Co., Ltd., Seoul (KR)

(72) Inventors: In Su Hwang, Seoul (KR); Dong Ik Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/384,422

(22) Filed: Jul. 23, 2021

(65) Prior Publication Data

US 2022/0028330 A1 Jan. 27, 2022

(30) Foreign Application Priority Data

Jul. 27, 2020 (KR) ..... 10-2020-0092910

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/027* (2013.01); *G09G 2330/028* (2013.01)

(58) Field of Classification Search
CPC .. G09G 3/32; G09G 3/2003; G09G 2310/027; G09G 2330/028
See application file for complete search history.

(56) References Cited

U.S. PATENT DOCUMENTS 8,344,992 B2 * 1/2013 Koyama ..... G02F 1/136286 345/100
2015/0060896 A1 * 3/2015 Okano ..... G09G 3/3225 257/88
2015/0310793 A1 * 10/2015 Kawashima ..... H01L 27/124 345/174
2016/0299387 A1 * 10/2016 Yamazaki ..... G06F 3/04164
2016/0377897 A1 * 12/2016 Kimura ..... G09G 3/3651 349/46
2018/0151124 A1 * 5/2018 An ..... G09G 3/3233
2018/0174517 A1 * 6/2018 Lee ..... G09G 3/3233
2020/0161399 A1 * 5/2020 Park ..... H01L 27/322

* cited by examiner

*Primary Examiner* — Andrew Sasinowski
(74) *Attorney, Agent, or Firm* — Seed IP Law Group LLP

(57) ABSTRACT

An electroluminescent display device according to the present disclosure includes a first pixel, a second pixel sharing a data line, a reference voltage line, and an initialization voltage line with the first pixel and disposed adjoining the first pixel, a first gate line provided to supply a first gate control signal to the first pixel, a second gate line provided to supply a second gate control signal to the second pixel, a third gate line provided to supply a third gate control signal to the first and second pixels, and a fourth gate line and provided to supply a fourth gate control signal to the first and second pixels, wherein a first driving element included in the first pixel and a second driving element included in the second pixel have different channel widths.

21 Claims, 20 Drawing Sheets

ELECTROLUMINESCENT DISPLAY DEVICE

CROSS-REFERENCE TO RELATED APPLICATION(S)

This application claims the benefit of Korean Patent Application No. 10-2020-0092910, filed on Jul. 27, 2020, which is hereby incorporated by reference as if fully set forth herein.

BACKGROUND

Technical Field

The present disclosure relates to an electroluminescent display device.

Description of the Related Art

Electroluminescent display devices are divided into inorganic electroluminescent display devices and organic electroluminescent display devices according to materials of emission layers. Each pixel of the electroluminescent display device includes a self-luminescent light-emitting element and adjusts luminance by controlling the amount of luminescence of the light-emitting element according to grayscales of image data. Each pixel circuit may include a driving transistor that supplies a pixel current to the light-emitting element, at least one switching transistor that programs a gate-source voltage of the driving transistor, and a capacitor. Such an electroluminescent display device is becoming advanced to a high-definition display device. High-definition models employ a double rate driving (DRD) type in order to secure a tap interval between source integrated circuits constituting a data driver and to reduce manufacturing cost.

BRIEF SUMMARY

The inventors of the present disclosure have recognized that, according to the DRD type in the related art, two pixels contiguously disposed in the horizontal direction having a single data line therebetween share the single data line and are sequentially driven by a data voltage supplied from the data line. When the DRD type is employed, processing margin can be secured and manufacturing cost is reduced because not only the number of output channels of the data driver but also the number of data lines connected to the output channels of the data driver are reduced to half the number of pixels belonging to one pixel line (here, one pixel line means a set of pixels contiguously disposed in the horizontal direction). However, the inventors have appreciated that, when the DRD type is employed, the number of gate lines may be doubled because driving timings of two pixels sharing a data line need to be temporally separated from each other. Gate lines are connected to a gate driver. When the number of gate lines increases, the circuit size of the gate driver and the area in which the gate driver is mounted increase, and thus panel design may be restricted due to an insufficient design area and a bezel area of a display panel may increase. The inventors of the present disclosure have realized that these problems in the related art may become serious in a pixel structure for internal compensation. That is, a pixel structure in which electrical characteristic change in a driving transistor including a plurality of switching transistors is compensated in a pixel circuit.

Accordingly, to solve the aforementioned problems as well as other problems in the related art, embodiments of the present disclosure provide an electroluminescent display device capable of reducing or minimizing increase in the number of gate lines in a DRD internal compensation type.

To achieve the technical benefits and other advantages of the disclosure, as embodied and broadly described herein, an electroluminescent display device includes a first pixel, a second pixel sharing a data line, a reference voltage line, and an initialization voltage line with the first pixel and disposed adjoining the first pixel in a horizontal direction, a first gate line connected to the first pixel and provided to supply a first gate control signal to the first pixel, a second gate line connected to the second pixel and provided to supply a second gate control signal to the second pixel, a third gate line commonly connected to the first and second pixels and provided to supply a third gate control signal to the first and second pixels, and a fourth gate line commonly connected to the first and second pixels and provided to supply a fourth gate control signal to the first and second pixels, wherein a channel width of a first driving element included in the first pixel differs from a channel width of a second driving element included in the second pixel.

DETAILED DESCRIPTION

Hereinafter, one or more embodiments will be described in detail with reference to the attached drawings. The same reference numbers will be used throughout this specification to refer to the same elements. In the following description, a detailed description of known functions or configurations incorporated herein will be omitted when it may obscure the subject matter of the present disclosure.

In an electroluminescent display device, a pixel circuit may include at least one of an N-channel transistor (NMOS) and a P-channel transistor (PMOS). A transistor is a tri-electrode element including a gate, a source, and a drain. The source is an electrode that supplies carriers to the transistor. Carriers flow from the source in the transistor. The drain is an electrode through which carriers are discharged from the transistor. Carriers flow from the source to the drain in the transistor. In the case of the N-channel transistor, a source voltage is lower than a drain voltage such that electrons can flow from the source to the drain because the electrons are carriers. Current flows from the drain to the source in the N-channel transistor. In the case of the P-channel transistor, a source voltage is higher than a drain voltage such that holes can flow from the source to the drain because the holes are carriers. In the P-channel transistor, current flows from the source to the drain because holes flow from the source to the drain. It should be noted that the source and the drain of the transistor are not fixed. For example, the source and the drain may change according to applied voltage. Accordingly, the present disclosure is not limited by the source and the drain of the transistor.

A scan signal (or a gate signal) applied to pixels swings between a gate on voltage and a gate off voltage. The gate on voltage is set to a voltage higher than a threshold voltage of the transistor and the gate off voltage is set to a voltage lower than the threshold voltage of the transistor. The transistor is turned on in response to the gate on voltage and turned off in response to the gate off voltage. In the case of the N-channel transistor, the gate on voltage may be a gate high voltage VGH and the gate off voltage may be a gate low voltage VGL. In the case of the P-channel transistor, the gate on voltage may be the gate low voltage VGL and the gate off voltage may be the gate high voltage VGH.

Figure 1:
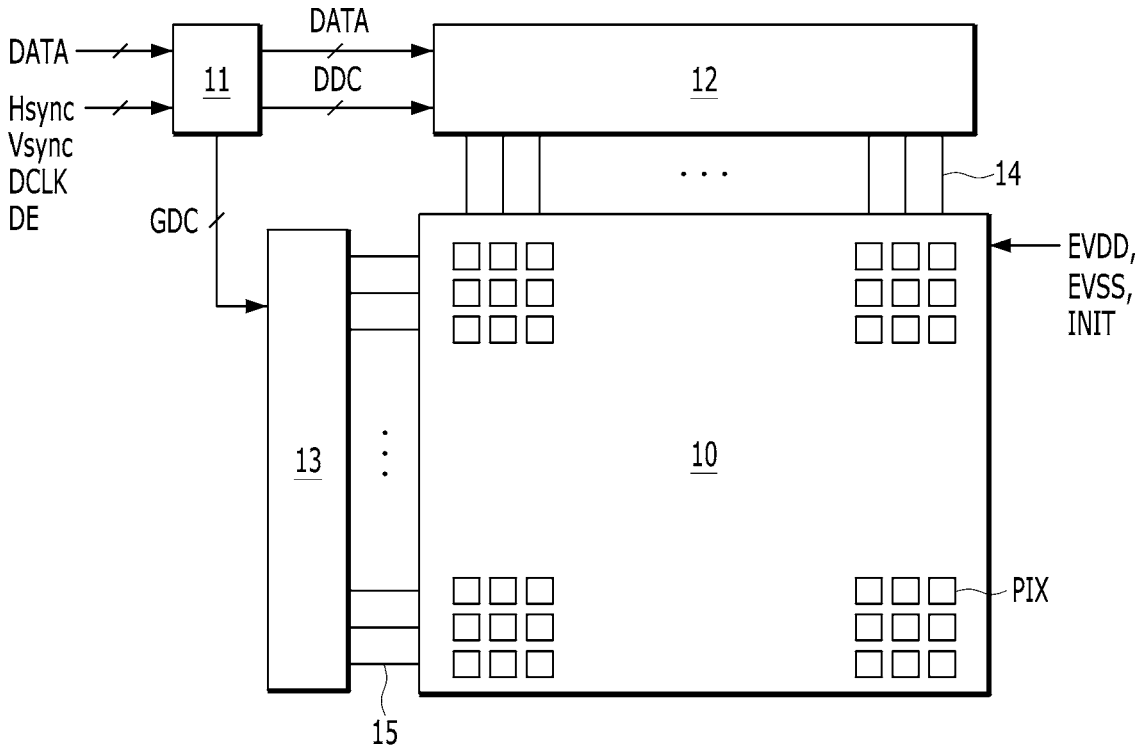
FIG. 1 is a block diagram showing an electroluminescent display device according to an embodiment of the present disclosure.

FIG. 1 is a block diagram showing an electroluminescent display device according to an embodiment of the present disclosure.

Referring to FIG. 1, the electroluminescent display device according to an embodiment of the present disclosure may include a display panel 10, a timing controller 11, a data driver 12, a gate driver 13, and a power supply circuit (not shown). In FIG. 1, all or some of the timing controller 11, the data driver 12, and the power supply circuit may be integrated into a drive integrated circuit.

In a screen on which an input image is displayed in the display panel 10, first signal lines 14 extending in a column direction (or vertical direction) intersect second signal lines 15 extending in a row direction (or horizontal direction) and pixels PIX are disposed at respective intersections in a matrix form to form a pixel array. The first signal lines may include data lines through which a data voltage is supplied and reference voltage lines through which a reference voltage is supplied. The second signal lines 15 may include gate lines through which gate control signals are supplied.

The pixel array includes a plurality of pixel lines. Here, a pixel line does not mean a physical signal line and may be defined as a set of pixels contiguously disposed in the horizontal direction and corresponding to one line or a pixel block corresponding to one line. The pixels PIX may be grouped into a plurality of groups to express various colors. When a pixel group for color expression is defined as a unit pixel, one unit pixel may include R (red), G (green), and B (blue) pixels and may further include a white (W) pixel. In the following embodiment, a case in which one unit pixel includes R, G, B, and W pixels will be exemplified.

Each pixel PIX includes a light-emitting element and a driving element for generating pixel current in response to a gate-source voltage and driving the light-emitting element. The light-emitting element includes an anode, a cathode, and an organic compound layer formed between the anode and the cathode. Although the organic compound layer may include a hole injection layer (HIL), a hole transport layer (HTL), an emission layer (EML), an electron transfer layer (ETL), and an electron injection layer (EIL), the organic compound layer is not limited thereto. When the pixel current flows through the light-emitting element, holes that have passed through the hole transfer layer (HTL) and electrons that have passed through the electron transfer layer (ETL) move to the emission layer (EML) to form excitons, resulting in emission of visible light from the emission layer (EML).

The driving element may be implemented as a thin film transistor. It is beneficial for electrical characteristics (e.g., threshold voltage, electron mobility, etc.) of the driving transistor be substantially uniform or uniform in all pixels, but electrical characteristic differences may be present between pixels due to process variation and element characteristic variation. The electrical characteristics of the driving transistor may change with lapse of display driving time, and deterioration degree differences may be present between pixels. To compensate for such electrical characteristic variation of the driving transistor, an internal compensation method may be applied to the electroluminescent display device. The internal compensation method compensates for electrical characteristic variation in the driving transistor through an internal compensator included in the pixel circuit such that the electrical characteristic variation does not affect pixel current. The internal compensator may include a plurality of switching elements implemented as thin film transistors and at least one storage capacitor.

Attempts to implement some transistors (particularly, switching transistors having sources or drains connected to a gate of a driving element) included in a pixel circuit as oxide transistors are increasing. The oxide transistor uses an oxide such as IGZO in which In (indium), Ga (gallium), Zn (zinc), and O (oxygen) are combined as a semiconductor material instead of polysilicon. Electron mobility of the oxide transistor is, advantageously, ten or more times higher than that of an amorphous silicon transistor and manufacturing cost thereof is much lower than that of a low temperature polysilicon (LTPS) transistor. In addition, the oxide transistor also has the advantage of high driving stability and reliability during low-speed driving in which an off period of the transistor is relatively long due to low off current. Accordingly, the oxide transistor can be employed for OLED TVs that require high definition and low power operation or cannot achieve a desired screen size through a low-temperature polysilicon process.

Touch sensors may be disposed on the pixel array of the display panel 10. Touch input may be sensed using additional touch sensors or through pixels. The touch sensors may be disposed on the screen of the display panel as on-cell type or add on type touch sensors or may be implemented as in-cell type touch sensors included in the pixel array.

In the pixel array, the pixels PIX may be driven through DRD internal compensation. For DRD internal compensation, pixels disposed on the same pixel line are grouped into groups each having two pixels, and two pixels belonging to the same group can share a single data line 14. Among the pixels PIX disposed on the same pixel line, pixels disposed on the left side of the shared data line 14 may be defined as first pixels and pixels disposed on the right side of the shared data line 14 may be defined as second pixels. Here, some of first gate lines corresponding to pixels of one pixel line may be selectively connected to any one of the first and second pixels, and thus driving timing of the first pixels and driving timing of the second pixels can be temporally separated in accordance with the DRD type. Particularly, the remaining first gate lines are commonly connected to the first and second pixels, and thus side effects caused when DRD internal compensation is employed, that is, a shortcoming of increase in the number of gate lines can be resolved. Furthermore, some of the gate lines may be additionally connected to a pixel disposed in another pixel line, and thus the number of gate lines can be further reduced. According to the present disclosure, it is possible to reduce the number of gate lines necessary for driving while employing DRD internal compensation to lessen restriction on panel design and reduce or minimize a bezel size.

The pixel array may further include high voltage power supply lines through which a high power supply voltage EVDD is supplied, low voltage power supply lines through which a low power supply voltage EVSS is supplied, and initialization voltage lines through which an initialization voltage INIT is supplied. Further, the low voltage power supply lines may be implemented as a barrel electrode shape connected to a light-emitting element under or above the light-emitting element.

The high voltage power supply lines, the low voltage power supply lines, and the initialization voltage lines may be connected to a power supply circuit. The power supply circuit may adjust a DC input voltage provided from a host system using a DC-DC converter to generate the gate on voltage VGH and the gate off voltage VGL necessary for operations of the data driver 12 and the gate driver 13 and generate the high power supply voltage EVDD, the initialization voltage INIT, and the lower power supply voltage EVSS necessary to drive the pixel array. The initialization voltage INIT may be set to be higher than the low power supply voltage EVSS. The initialization voltage INIT is used to initialize a gate voltage of the driving element in a pixel PIX and may be set to be higher than a reference voltage for initializing a source voltage of the driving element in the pixel PIX. Particularly, a difference between the initialization voltage INIT and the reference voltage may be set to be higher than the threshold voltage of the driving element such that the driving element can be set in an on state in an initialization period.

Such pixels PIX receive the high power supply voltage EVDD, the initialization voltage INIT, and the low power supply voltage EVSS from the power supply circuit and receive a data voltage and the reference voltage from the data driver 12. First to third embodiments may be derived according to connection between the first and second signal lines 14 and 15 and the pixels PIX. The first embodiment will be described later with reference to FIG. 5 to FIG. 13, the second embodiment will be described later with reference to FIG. 14 to FIG. 21, and the third embodiment will be described later with reference to FIG. 22 to FIG. 24.

The timing controller 11 provides digital image data DATA transmitted from the host system (not shown) to the data driver 12. The timing controller 11 receives timing signals such as a vertical synchronization signal Vsync, a horizontal synchronization signal Hsync, a data enable signal DE, and a dot clock signal DCLK from the host system and generates timing control signals for controlling operation timing of the data driver 12 and the gate driver 13. The timing control signals may include a gate timing control signal GDC for controlling operation timing of the gate driver 13 and a data timing control signal DDC for controlling operation timing of the data driver 12.

The data driver 12 samples and latches the digital image data received from the timing controller 11 on the basis of the data timing control signal DDC to convert the digital image data DATA into parallel data, and a digital-analog converter (DAC) converts the digital image data DATA into an analog data voltage according to a gamma reference voltage and provides the data voltage to the pixels PIX through the data lines. Data voltages may be voltage values corresponding to grayscales of an image to be displayed in the pixels PIX. The data driver 12 may be composed of a plurality of source driver integrated circuits. When DRD internal compensation is employed, the number of data lines necessary to drive the pixels PIX is halved and thus the size of the source driver integrated circuits connected to the data lines is also reduced.

The source driver integrated circuit may include a shift register, a latch, a level shifter, a DAC, and an output buffer. The shift register shifts a clock signal input from the timing controller 11 to sequentially output clocks for sampling, the latch samples and latches digital image data DATA at sampling clock timing from the shift register and simultaneously outputs sampled pixel data, the level shifter adjusts the voltage of pixel data input from the latch within an input voltage range of the DAC, and the DAC converts the pixel data from the level shifter into a data voltage with reference to a gamma compensation voltage and then provides the data voltage to the data lines through the output buffer.

The gate driver 13 generates gate control signals based on the gate timing control signal GDC and provides the gate control signals to the gate lines. The gate driver 13 may be composed of a plurality of gate drive integrated circuits each including a gate shift register, a level shifter for converting an output signal of the gate shift register into a switch width suitable for thin film transistor (TFT) operation of a pixel, and an output buffer. Otherwise, the gate driver 13 may be directly formed on the substrate of the display panel 10 in a gate driver in panel (GIP) type. In the case of GIP type, the level shifter may be mounted on a printed circuit board (PCB) and the gate shift register may be formed in a bezel area that is a non-display area of the display panel 10.

The gate shift register includes a plurality of output stages connected in a cascade manner. The output stages are independently connected to the gate lines and output gate control signals to the gate lines. The number of output stages and gate control signals for driving pixels PIX disposed in one pixel line is determined by the number of gate lines corresponding thereto. Since some of the gate control signals are commonly connected to all pixels PIX of one pixel line and/or some pixels PIX of another pixel line in DRD internal compensation of the present embodiment, the number of gate lines and the number of gate control signals can be reduced. In addition, the number of output stages is reduced in proportion to the reduced number of gate control signals, and thus a narrow bezel can be easily realized. Gate control signals supplied in the same phase to all pixels PIX of one pixel line through commonly connected gate lines may include at least some of gate control signals other than a scan control signal (synchronized with data write timing).

The host system may be a mobile device, a wearable device and/or an application processor (AP) in a virtual/augmented reality device. Further, the host system may be a main board of a television system, a set-top box, a navigation system, a personal computer, a home theater system, or the like, but the host system is not limited thereto.

Figure 2:
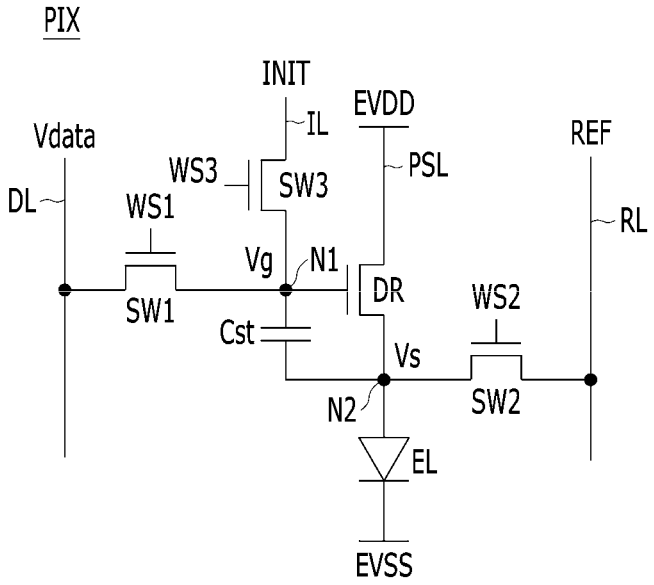
FIG. 2 is a diagram showing an equivalent circuit of one pixel formed in a display panel of FIG. 1.

FIG. 2 is a diagram showing an equivalent circuit of a single pixel PIX formed in the display panel of FIG. 1.

Referring to FIG. 2, a pixel circuit may include a driving transistor DR, a light-emitting element EL, and an internal compensator.

The driving transistor DR generates pixel current for driving the light-emitting element EL. The gate of the driving transistor DR is connected to a first node N1, a first electrode (one of the source and the drain) is connected to an input terminal for the high power supply voltage EVDD, and a second electrode (the other one of the source and the drain) is connected to the light-emitting element EL. The input terminal for the high power supply voltage EVDD is connected to a high voltage power supply line PSL to receive the high power supply voltage EVDD from the high voltage power supply line PSL such that the high power supply voltage EVDD is supplied to the first electrode of the driving transistor DR.

The light-emitting element EL includes an anode connected to a second node N2, a cathode connected to an input terminal for the low power supply voltage EVSS, and an emission layer provided between the anode and the cathode. The light-emitting element EL may be implemented as an organic light-emitting diode including an organic emission layer or an inorganic light-emitting diode including an inorganic emission layer.

The internal compensator is provided to compensate for change in the threshold voltage of the driving transistor DR and may include three switching transistors SW1, SW2, and SW3 and a single storage capacitor Cst. Here, at least some (e.g., SW1) of the switching transistors may be configured as an oxide transistor having excellent off current characteristic such that the gate-source voltage Vg-Vs of the driving transistor DR can be stably maintained.

The internal compensator controls voltages Vg and Vs of the first and second nodes N1 and N2 according to switching operations of the first to third switching transistors SW1, SW2, and SW3 and reflects change in the threshold voltage and electron mobility of the driving transistor DR in the gate-source voltage Vg-Vs of the driving transistor DR. The internal compensator serves to compensate for change in the threshold voltage and electron mobility of the driving transistor DR such that pixel current is not affected by the change. Accordingly, an operation of compensating for change in the threshold voltage and electron mobility of the driving transistor DR is performed in the pixel. This internal compensation operation is beneficial to be distinguished from an external compensation operation for correcting digital image data in response to change in electrical characteristics of the driving transistor DR.

The first switching transistor SW1 is provided to apply a data voltage Vdata to the first node N1. A first electrode of the first switching transistor SW1 is connected to a data line DL and a second electrode thereof is connected to the first node N1. In addition, the gate of the first switching transistor SW1 is connected to a first gate line. The first switching transistor SW1 is switched according to a first gate control signal WS1 from the first gate line.

The second switching transistor SW2 is provided to apply a reference voltage REF to the second node N2. A first electrode of the second switching transistor SW2 is connected to a reference voltage line RL and a second electrode thereof is connected to the second node N2. In addition, the gate of the second switching transistor SW2 is connected to a second gate line. The second switching transistor SW2 is switched according to a second gate control signal WS2 from the second gate line.

The third switching transistor SW3 is provided to apply the initialization voltage INIT to the first node N1. A first electrode of the third switching transistor SW3 is connected to an initialization voltage line IL and a second electrode thereof is connected to the first node N1. In addition, the gate of the third switching transistor SW3 is connected to a third gate line. The third switching transistor SW3 is switched according to a third gate control signal WS3 from the third gate line.

The storage capacitor Cst is connected between the first node N1 and the second node N2 and stores and maintains the gate-source voltage Vg-Vs of the driving transistor DR determined according to switching operations of the first to third switching transistors SW1, SW2, and SW3.

Figure 3:
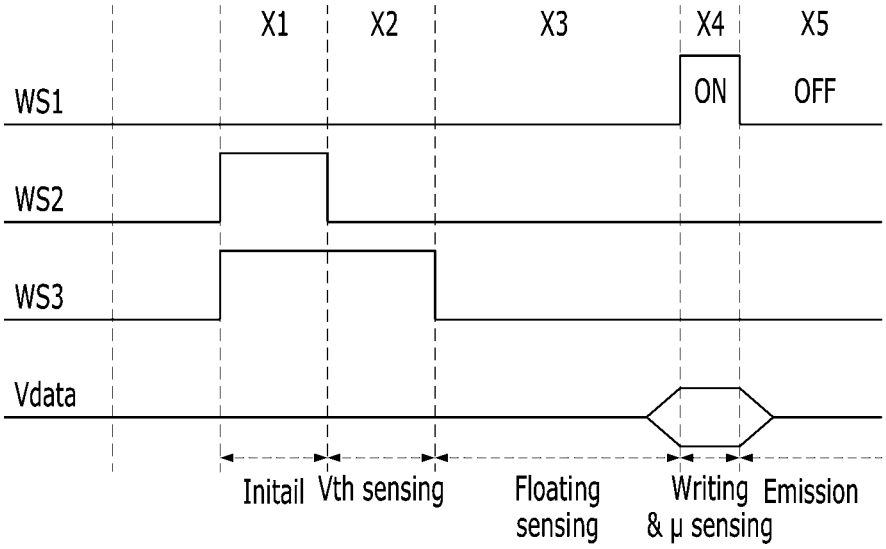
FIG. 3 is a diagram showing driving timing of the pixel of FIG. 2.

FIG. 3 is a diagram showing driving timing of the pixel of FIG. 2. FIGS. 4A, 4B, 4C, 4D, and 4E are diagrams respectively showing pixel operation states in first, second, third, fourth, and fifth periods of FIG. 3.

Referring to FIG. 3, the pixel driving timing may include the first to fifth periods X1 to X5.

Figure 4A:
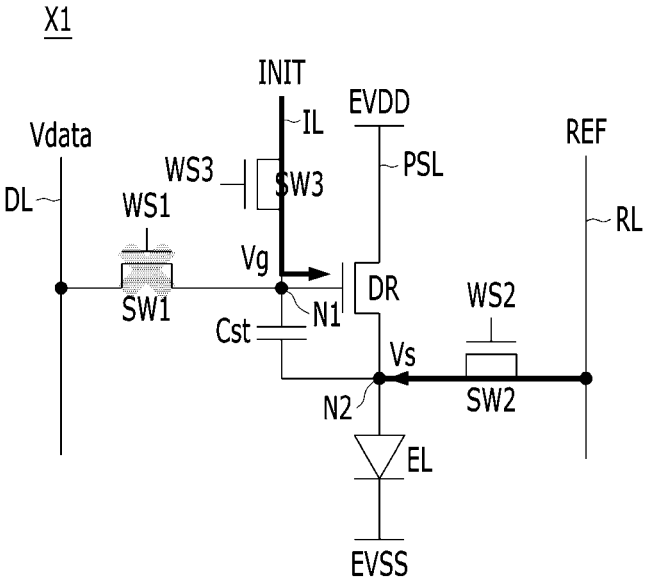
FIGS. 4A, 4B, 4C, 4D, and 4E are diagrams showing pixel operating states in first, second, third, fourth, and fifth periods of FIG. 3.

In the first period X1, the first node N1 is initialized to the initialization voltage INIT and the second node N2 is initialized to the reference voltage REF. To this end, the second switching transistor SW2 is switched on according to the second gate control signal WS2 from the second gate line and the third switching transistor SW3 is switched on according to the third gate control signal WS3 from the third gate line, as shown in FIG. 4A. The driving transistor DR satisfies a turn-on condition because "INIT-REF" that is the gate-source voltage Vg-Vs is higher than the threshold voltage Vth thereof.

The second and third periods X2 and X3 are periods for sensing the threshold voltage of the driving transistor DR and reflecting the sensed threshold voltage in the gate-source voltage Vg-Vs. In the case of a high definition model, a time necessary to drive one pixel line is short and thus the second period X2 may be insufficient to sense the threshold voltage of the driving transistor DR. Accordingly, the third period X3 in a floating state may be additionally used to sense the threshold voltage of the driving transistor DR. Since the driving transistor DR maintains a turn-on state until the threshold voltage is sampled, the threshold voltage can be additionally sensed in the third period X3 in the floating state.

Figure 4B:
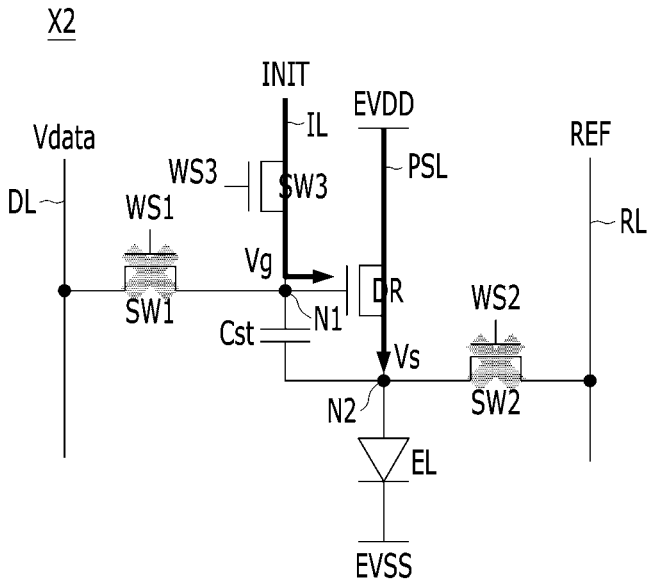

Referring to FIG. 4B, in the second period X2, the third switching transistor SW3 maintains an on-switching state and the second transistor SW2 is switched off, and thus the driving transistor DR operates as a source follower. That is, the voltage Vs of the second node N2 increases from the reference voltage REF to the initialization voltage INIT according to drain-source current of the driving transistor DR in a state in which the voltage Vg of the first node N1 is fixed to the initialization voltage INIT.

Figure 4C:
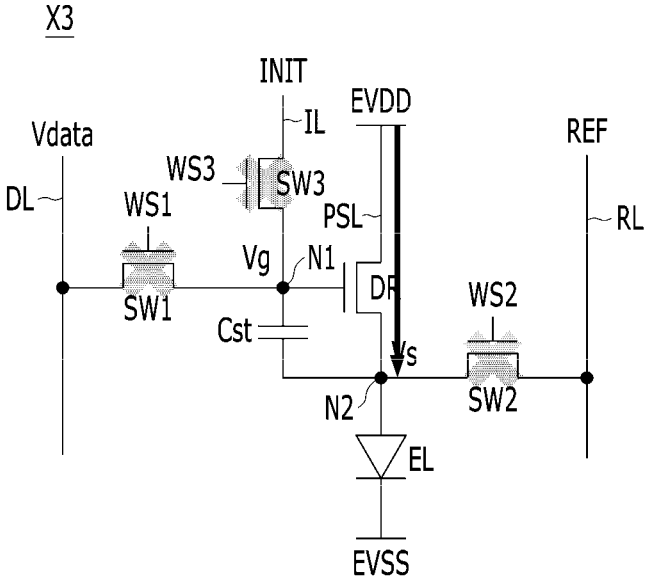

Referring to FIG. 4C, in the third period X3, the third switching transistor SW3 is switched off and the second transistor SW2 maintains the off-switching state, and thus both the first and second nodes N1 and N2 are floated. In this floating state, the source follower operation continues. The source follower operation in the third period can be performed because the voltage Vs of the second node N2 increases more rapidly than the voltage Vg of the first node N1 according to the drain-source current of the driving transistor DR. The source follower operation continues until the driving transistor DR is turned off, and a gate-source voltage Vg-Vs when the driving transistor DR is turned off is sampled with the threshold voltage Vth of the driving transistor DR and stored in the storage capacitor Cst.

Figure 4D:
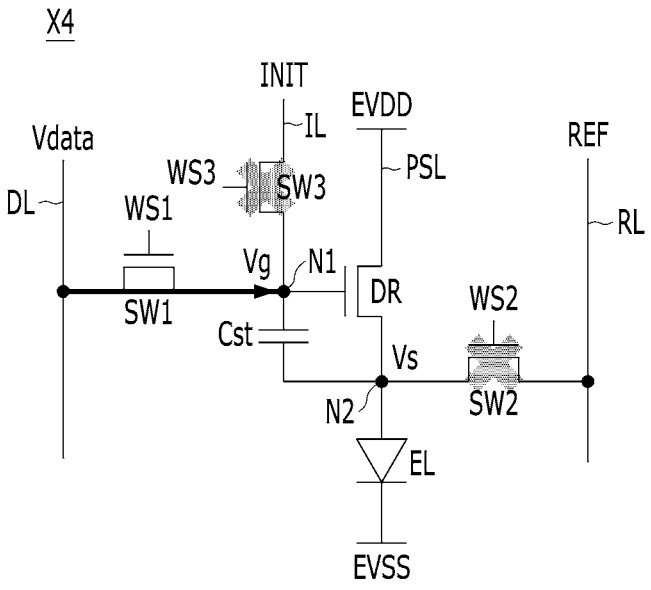

The fourth period X4 is provided to reflect change in the electron mobility of the driving transistor DR in the gate-source voltage Vg-Vs. The gate-source voltage Vg-Vs is complementarily adjusted while satisfying the turn-on condition in accordance with change in the electron mobility of the driving transistor DR. Specifically, as shown in FIG. 4D, the first switching transistor SW is switched on according to the first gate control signal WS1 from the first gate line and thus the data voltage Vdata is applied to the first node N1 in the fourth period X4. The driving transistor DR satisfies the turn-on condition because "Vdata+Vth" that is the gate-source voltage Vg-Vs is higher than the threshold voltage Vth thereof. The source follower operation of the driving transistor DR is also performed in the fourth period X4. The voltage Vs of the second node N2 increases from a value set in the third period X3 according to the drain-source current of the driving transistor DR in a state in which the voltage Vg of the first node N1 is fixed to the data voltage Vdata. The slope of voltage increase of the second node N2 is proportional to the electron mobility of the driving transistor DR. When the electron mobility of the driving transistor DR increases to be higher than a reference value, the gate-source voltage Vg-Vs of the driving transistor DR is adjusted to be lower than the reference value according to the voltage increase slope of the second node N2 in the fourth period X4. On the other hand, when the electron mobility of the driving transistor DR decreases to be lower than the reference value, the gate-source voltage Vg-Vs of the driving transistor DR is adjusted to be higher than the reference value according to the voltage increase slope of the second node N2 in the fourth period X4. According to this complementary principle, the gate-source voltage Vg-Vs can be automatically compensated in accordance with change in the electron mobility of the driving transistor DR.

Figure 4E:
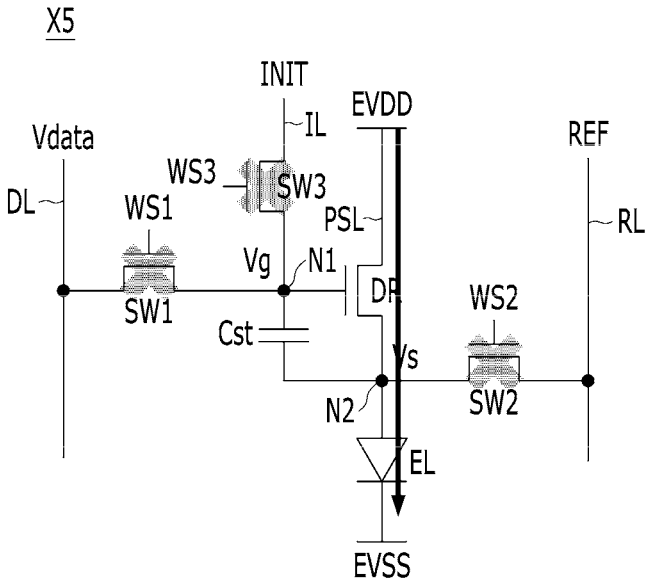

The fifth period X5 is provided to cause the light-emitting element EL to emit light according to the drain-source current of the driving transistor DR. The drain-source current of the driving transistor DR is proportional to the square of a gate-source voltage Vg-Vs of the driving transistor DR set in the fourth period X4. As shown in FIG. 4E, the first switching transistor SW1 is also switched off and thus both the first and second nodes N1 and N2 are floated in the fifth period X5. In this state, the gate-source voltage Vg-Vs of the driving transistor DR maintains the value set in the fourth period X4 and thus drain-source current corresponding thereto continuously flows through the driving transistor DR. Both the voltages Vg and Vs of the first and second nodes N1 and N2 increase (the voltages Vg and Vs increase together because the floated first and second nodes N1 and N2 are coupled through the storage capacitor) while the gate-source voltage Vg-Vs is maintained according to the drain-source current. This voltage increase operation is performed until the voltage Vs of the second node N2 reaches an operating point voltage of the light-emitting element EL. When the voltage Vs of the second node reaches the operating point voltage of the light-emitting element EL, the light-emitting element EL is turned on to emit light with brightness in proportion to pixel current (i.e., drain-source current when the light-emitting element EL is turned on).

The pixel current that causes the light-emitting element EL to emit light in the fifth period X5 is a value determined by the gate-source voltage Vg-Vs of the driving transistor DR set in the fourth period X4. Since change in the threshold voltage and electron mobility is reflected in the gate-source voltage Vg-Vs, distortion of the pixel current due to change in electrical characteristics of the driving transistor DR can be reduced or minimized.

The above-described pixel configuration and basic driving timing may be applied to embodiments below. Hereinafter, various methods for reducing the number of gate lines when DRD internal compensation is employed are proposed.

First Embodiment

Figure 5:
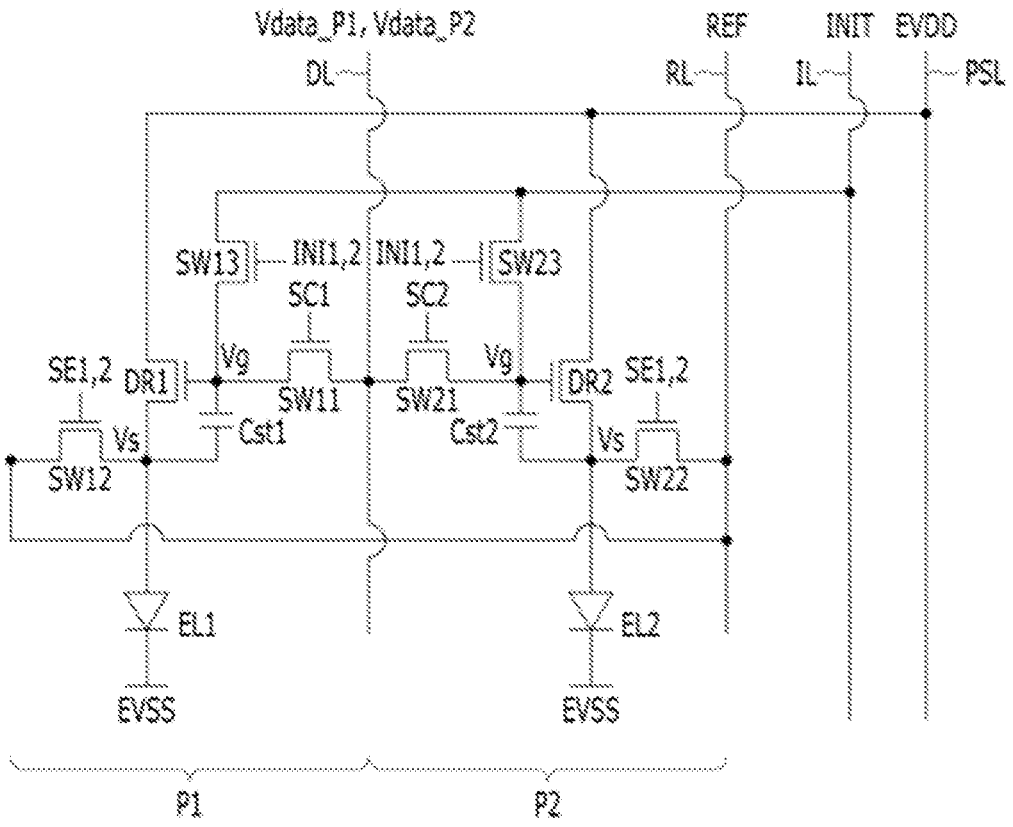
FIG. 5 to FIG. 7 are diagrams showing configurations of connections between two pixels and signal lines according to a first embodiment of the present disclosure.
Figure 6:
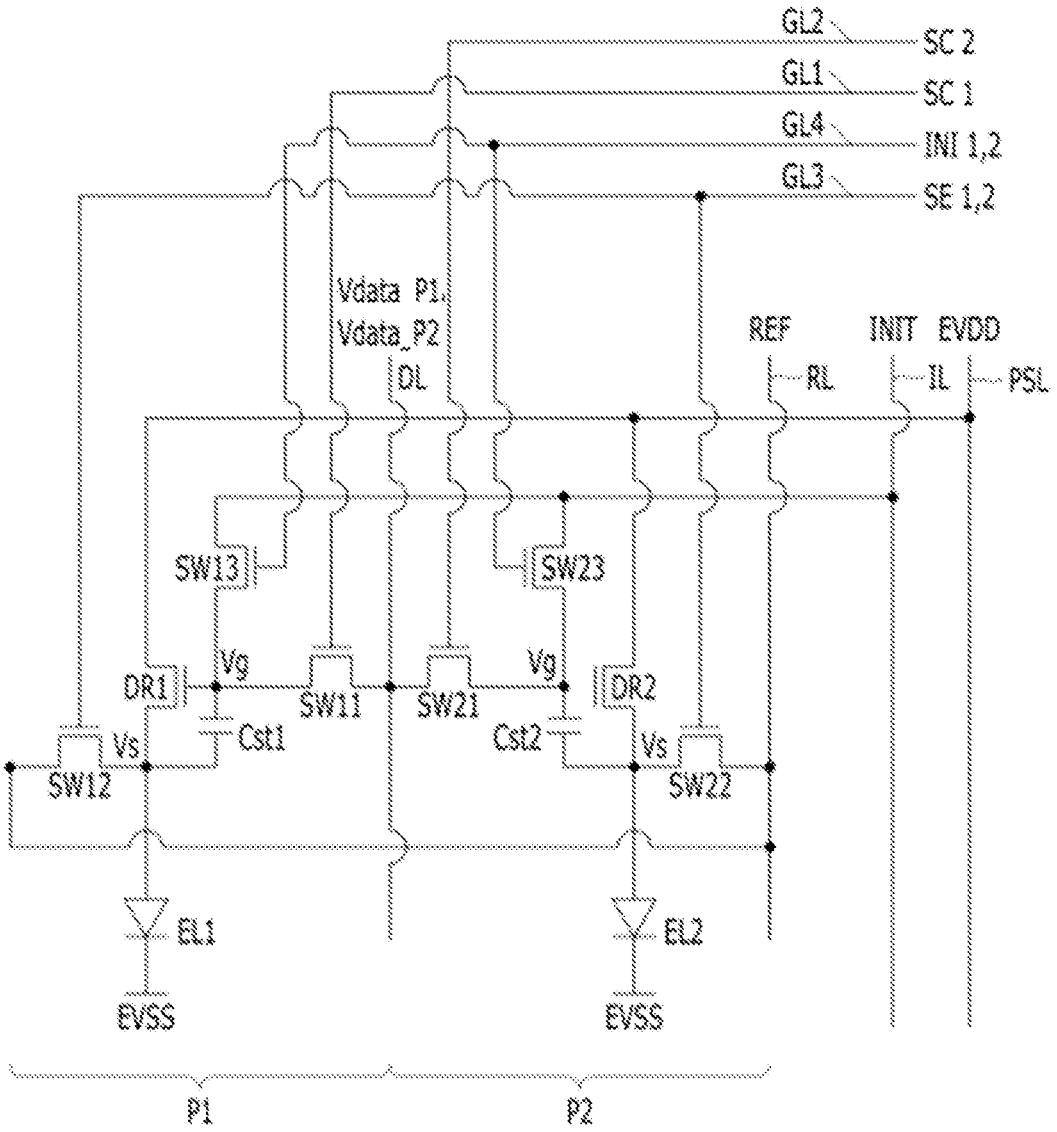
Figure 7:
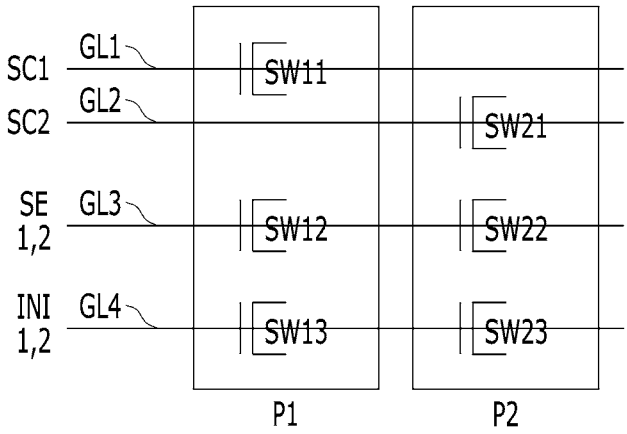

FIG. 5 to FIG. 7 are diagrams showing configurations of connections between two pixels and signal lines (including data lines and gate lines) according to a first embodiment of the present disclosure.

Referring to FIG. 5 and FIG. 6, two pixels P1 and P2 according to the first embodiment are contiguously disposed in the horizontal direction having a data line DL interposed therebetween and are driven in a time division manner while sharing the data line DL for DRD internal compensation.

The first pixel P1 may include a first light-emitting element EL1 having a first color, a first driving transistor DR1 that drives the first light-emitting element EL1, a first group of switching transistors SW11, SW12, and SW13 connected to the first driving transistor DR1, and a first storage capacitor Cst1 and operate in the method as described with reference to FIG. 3 to FIG. 4E.

The second pixel P2 may include a second light-emitting element EL2 having a second color, a second driving transistor DR2 that drives the second light-emitting element EL2, a second group of switching transistors SW21, SW22, and SW23 connected to the second driving transistor DR2, and a second storage capacitor Cst2 and operate through a method similar to the method as described with reference to FIG. 3 to FIG. 4E.

For time division driving, a case in which the first group of switching transistors SW11, SW12, and SW13 and the second group of switching transistors SW21, SW22, and SW23 are connected to different gate lines (i.e., six gate lines) may be considered. However, in this case, the number of gate lines is considerably greater than that in a non-DRD type in which the first group of switching transistors SW11, SW12, and SW13 and the second group of switching transistors SW21, SW22, and SW23 are connected to three gate lines (i.e., SW11 and SW21 are connected to a first gate line, SW12 and SW22 are connected to a second gate line, and SW13 and SW23 are connected to a third gate line).

Accordingly, the first embodiment proposes a method of connecting the first group of switching transistors SW11, SW12, and SW13 and the second group of switching transistors SW21, SW22, and SW23 to four gate lines GL1 to GL4 in an electroluminescent display device for time division driving.

To this end, the first gate line GL1 is connected to the first pixel P1 to supply a first gate control signal SC1 to the first pixel P1, and the second gate line GL2 is connected to the second pixel P2 to supply a second gate control signal SC2 to the second pixel P2.

The third gate line GL3 is commonly connected to the first and second pixels P1 and P2 to supply a third gate control signal SE1,2 to the first and second pixels P1 and P2. In addition, the fourth gate line GL4 is commonly connected to the first and second pixels P1 and P2 to supply a fourth gate control signal INI1,2 to the first and second pixels P1 and P2.

The first gate control signal SC1 corresponds to a first data voltage Vdata_P1 to be supplied to the first pixel P1, and the second gate control signal SC2 corresponds to a second data voltage Vdata_P2 to be supplied to the second pixel P2. The third gate control signal SE1,2 corresponds to the reference voltage REF to be commonly supplied to the first and second pixels P1 and P2, and the fourth gate control signal INI1,2 corresponds to the initialization voltage INIT to be commonly supplied to the first and second pixels P1 and P2.

Since the first data voltage Vdata_P1 and the second data voltage Vdata_P2 need to be distributed to the first pixel P1 and the second pixel P2 through the same data line DL, pixel writing timings of the first data voltage Vdata_P1 and the second data voltage Vdata_P2 need to be temporally separated. If not, the first data voltage Vdata_P1 and the second data voltage Vdata_P2 may be mixed to cause image distortion.

On the other hand, the reference voltage REF may be safely simultaneously supplied to the first pixel P1 and the second pixel P2 because it is a first common voltage applied to the first pixel P1 and the second pixel P2 as the same level. Likewise, the initialization voltage INIT may also be safely simultaneously supplied to the first pixel P1 and the second pixel P2 because it is a second common voltage applied to the first pixel P1 and the second pixel P2 as the same level.

Referring to FIG. 7, in the first embodiment, the first and second gate control signals SC1 and SC2 synchronized with supply timings of the first and second data voltages Vdata_P1 and Vdata_P2 are temporally separated and selectively supplied to the first and second pixels P1 and P2, the third gate control signal SE1,2 synchronized with a supply timing of the reference voltage REF is commonly supplied to the first and second pixels P1 and P2, and the fourth gate control signal INI1,2 synchronized with a supply timing of the initialization voltage INIT is commonly supplied to the first and second pixels P1 and P2. According to the first embodiment, it is possible to reduce the number of gate lines necessary for DRD internal compensation of pixels disposed on one pixel line from six to four by separately supplying the first and second gate control signals SC1 and SC2 to the first and second pixels P1 and P2 through two gate lines, supplying the third gate control signal SE1,2 to the first and second pixels P1 and P2 through a single gate line, and supplying the fourth gate control signal INI1,2 to the first and second pixels P1 and P2 through a single gate line.

A configuration of connections between the four gate lines GL1 to GL4, and switching transistors and driving transistors in the first and second pixels P1 and P2 will be described in more detail below.

The first group of switching transistors SW11, SW12, and SW13 includes the first switching transistor SW11 that operates according to the first gate control signal SC1 from the first gate line GL1 to connect the gate of the first driving transistor DR1 to the data line DL, the second switching transistor SW12 that operates according to the third gate control signal SE1,2 from the third gate line GL3 to connect the source of the first driving transistor DR1 to the reference voltage line RL, and the third switching transistor SW13 that operates according to the fourth gate control signal INI1,2 from the fourth gate line GL4 to connect the gate of the first driving transistor DR1 to the initialization voltage line IL.

The second group of switching transistors SW21, SW22, and SW23 includes the fourth switching transistor SW21 that operates according to the second gate control signal SC2 from the second gate line GL2 to connect the gate of the second driving transistor DR2 to the data line DL, the fifth switching transistor SW22 that operates according to the third gate control signal SE1,2 from the third gate line GL3 to connect the source of the second driving transistor DR2 to the reference voltage line RL, and the sixth switching transistor SW23 that operates according to the fourth gate control signal INI1,2 from the fourth gate line GL4 to connect the gate of the second driving transistor DR2 to the initialization voltage line IL.

The first to fourth gate lines GL1 to GL4 are connected to the gate driver (13 in FIG. 1), the data line DL and the reference voltage line RL are connected to the data driver (12 in FIG. 1), and the initialization voltage line IL is connected to the power supply circuit.

The gate driver 13 generates the first gate control signal SC1, supplies the first gate control signal SC1 to the first gate line GL1, generates the second gate control signal SC2, supplies the second gate control signal SC2 to the second gate line GL2, generates the third gate control signal SE1,2, supplies the third gate control signal SE1,2 to the third gate line GL3, generates the fourth gate control signal INI1,2, and supplies the fourth gate control signal INI1,2 to the fourth gate line GL4. The data driver 12 supplies the first data voltage Vdata_P1 to be supplied to the first pixel P1 to the data line DL in synchronization with the first gate control signal SC1 at an on level, supplies the second data voltage Vdata_P2 to be supplied to the second pixel P2 to the data line in synchronization with the second gate control signal SC2 at the on level, and supplies the reference voltage REF to be commonly supplied to the first and second pixels P1 and P2 to the reference voltage line RL in synchronization with the third gate control signal SE1,2 at the on level. In addition, the power supply circuit supplies the initialization voltage INIT to be commonly supplied to the first and second pixels P1 and P2 to the initialization voltage line IL in synchronization with the fourth gate control signal INI1,2 at the on level.

Figure 8:
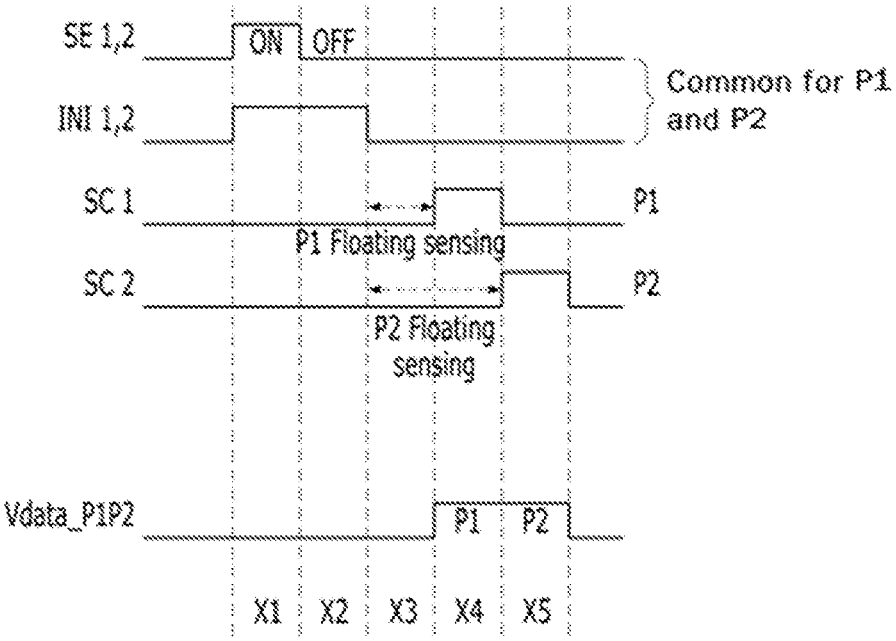
FIG. 8 is a diagram showing driving timings of two pixels according to the first embodiment.
Figure 9:
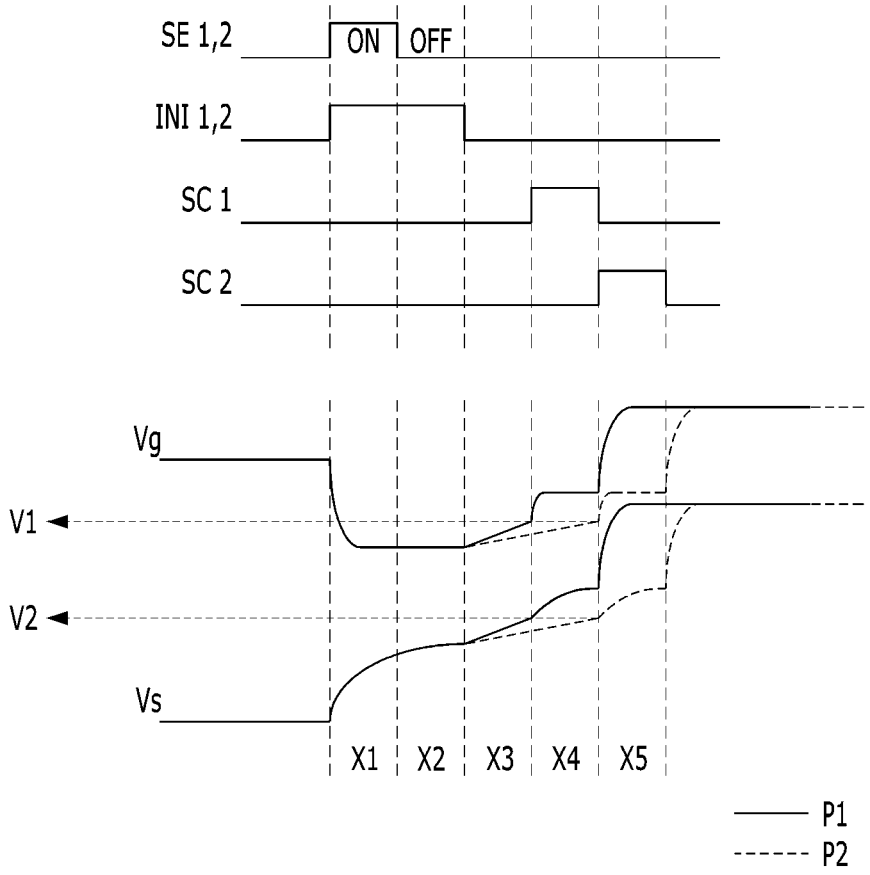
FIG. 9 is a diagram showing the concept of complement for reducing compensation variation due to a floating time difference in two pixels according to the first embodiment.

FIG. 8 is a diagram showing driving timings of the two pixels P1 and P2 according to the first embodiment. FIG. 9 is a diagram showing the concept of complement for reducing compensation variation due to a floating time difference in the two pixels P1 and P2 according to the first embodiment.

Referring to FIG. 8, driving timings for the first and second pixels P1 and P2 may include first to fifth periods X1 to X5. The first period X1, the second period X2, the third period X3, the fourth period X4, and the fifth period X5 may be sequentially provided at a specific interval, for example, one horizontal period interval.

In the first to fifth periods X1 to X5, the first to third gate control signals SC1, SC2, and SE1,2 may have the same pulse width while having different pulse phases. In addition, the fourth gate control signal INI1,2 may have a pulse width twice that of the first to third gate control signals SC1, SC2, and SE1,2. The fourth gate control signal INI1,2 has the same pulse phase as that of the third gate control signal SE1,2, and the pulse phase of the fourth gate control signal INI1,2 precedes those of the first and second gate control signals SC1 and SC2. In this manner, any of the pulse width and the pulse phase of each of the first to fourth gate control signals SC1, SC2, SE1,2, and INI1,2 is designed to be different from that of the remaining three gate control signals to allow internal compensation operation and to contribute to a simple operation scheme of the gate driver.

All of the first to fourth gate control signals SC1, SC2, SE1,2, and INI1,2 swing between an on level ON and an off level OFF and have the same pulse amplitude. The third gate control signal SE1,2 has the on level ON only in the first period X1, the fourth gate control signal INI1,2 has the on level ON only in the first and second periods X1 and X2, the first gate control signal SC1 has the on level ON only in the fourth period X4, and the second gate control signal SC2 has the on level ON only in the fifth period X5. In addition, all of the first to fourth gate control signals SC1, SC2, SE1,2, and INI1,2 have the off level OFF in the third period X3. The DRD internal compensation operation can also be smoothly performed in a state in which the number of gate lines is reduced according to such timing settings for the first to fourth gate control signals SC1, SC2, SE1,2, and INI1,2.

In the first to fifth periods X1 to X5, operation of the first pixel P1 for DRD internal compensation operation is substantially the same as that described in FIG. 4A to FIG. 4E. However, operation of the second pixel P2 differs therefrom in that a floating sensing period is longer than that of the first pixel P1. In the case of the second pixel P2, floating sensing is performed in the third and fourth periods X3 and X4 and data voltage writing and electron mobility compensation are performed in the fifth period X5.

When the first and second pixels P1 and P2 share the third gate control signal SE1,2 and the fourth gate control signal INI1,2 in order to reduce the number of gate lines, a floating time difference between the first and second pixels P1 and P2 is inevitably generated as shown in FIG. 8. Such a floating time difference causes variation in time allocated to compensation of the threshold voltage of the driving transistor, resulting in a difference in degree of compensation between the first and second pixels P1 and P2.

Current carrying capacity of the driving transistor is determined by a channel width. To reduce or minimize side effects caused by a floating time difference between the first and second pixels P1 and P2, a first channel width of the first driving transistor DR1 included in the first pixel P1 and a second channel width of the second driving transistor DR2 included in the second pixel P2 may be differently designed. In other words, it is beneficial that the first channel width of the first driving transistor DR1 be designed to have a first value in the first pixel P1 having a relatively short floating time and the second channel width of the second driving transistor DR2 be designed to have a second value in the second pixel P2 having a relatively long floating time. When the channel widths are differently designed in this manner, the source voltages Vs of the first and second driving transistors DR1 and DR2 can become identical to "V2" and the gate voltages Vg of the first and second driving transistors DR1 and DR2 can become identical to "V1" at a data voltage writing time, as shown in FIG. 9. As a result, a compensation difference between the first and second pixels P1 and P2 can be resolved.

FIG. 10 to FIG. 13 are diagrams showing examples in which the first embodiment of the present disclosure is applied to one unit pixel consisting of four pixels.

Figure 10:
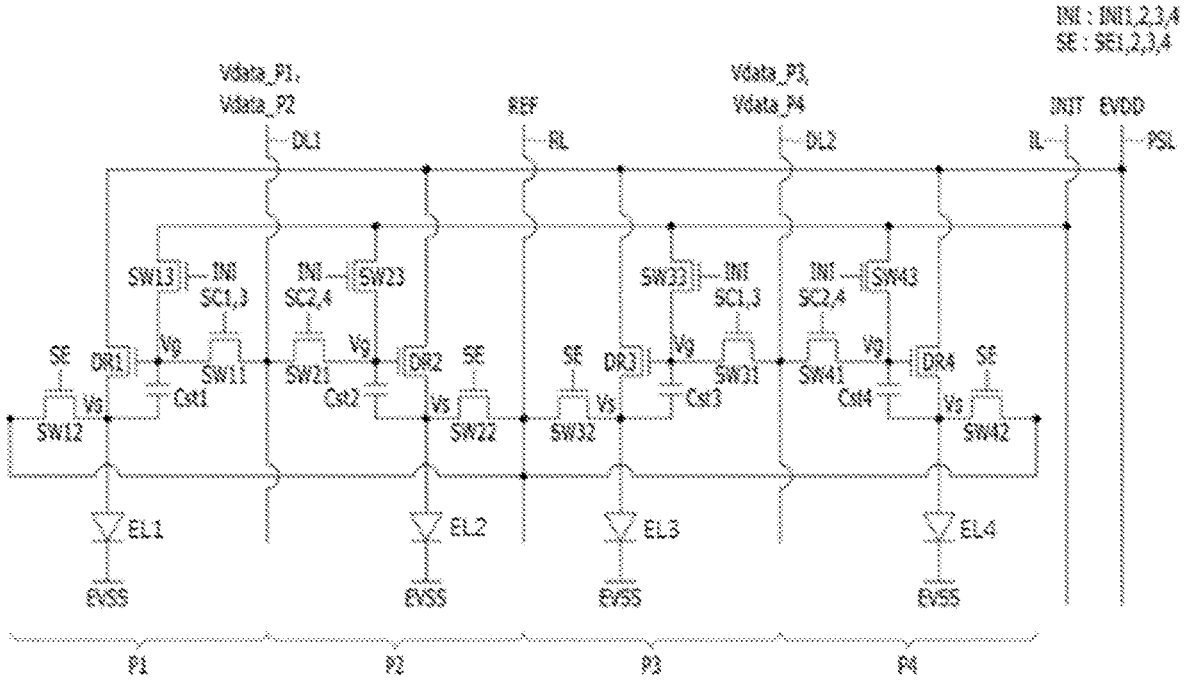
FIG. 10 to FIG. 13 are diagrams showing examples in which the first embodiment of the present disclosure is applied to one unit pixel consisting of four pixels.
Figure 11:
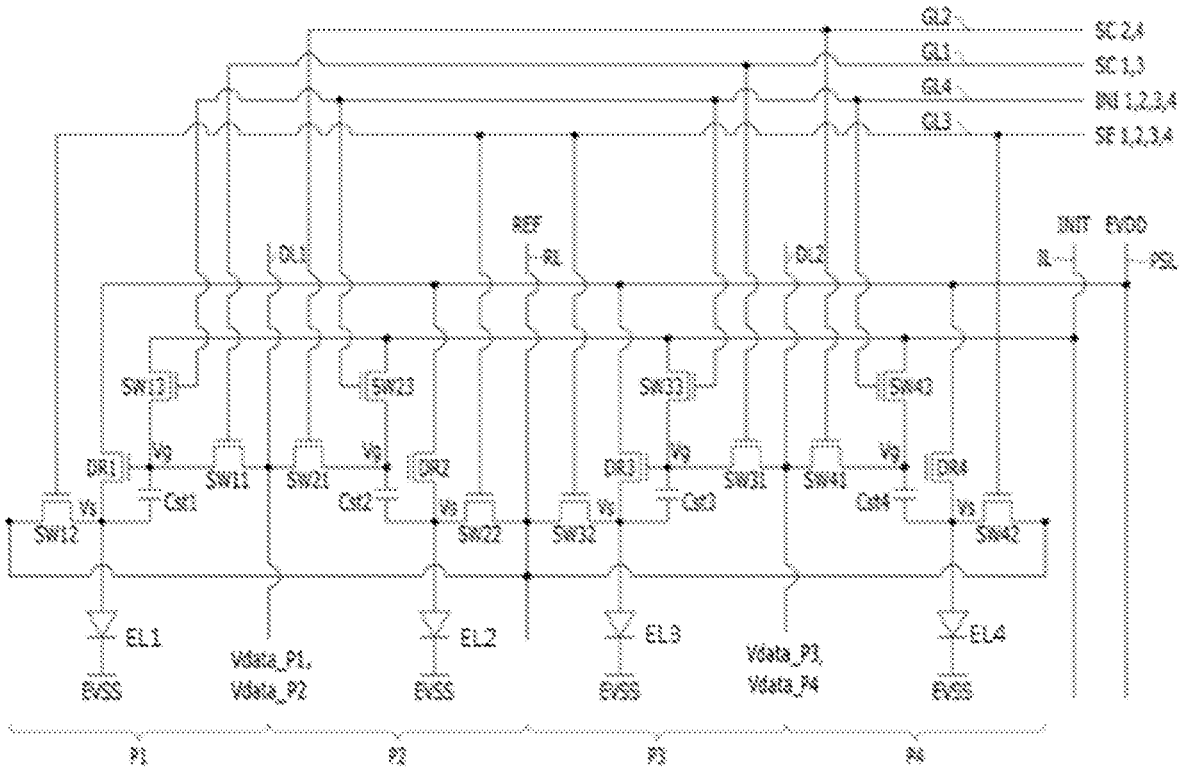

Referring to FIG. 10 and FIG. 11, one unit pixel includes first to fourth pixels P1 to P4 contiguously disposed in the horizontal direction and sharing one reference voltage line RL. The first and second pixels P1 and P2 are contiguously disposed having a first data line DL1 interposed therebetween and share the first data line DL1 to be driven in a time division manner. In addition, the third and fourth pixels P3 and P4 are contiguously disposed having a second data line DL2 interposed therebetween and share the second data line DL2 to be driven in a time division manner.

The first pixel P1 may include a first light-emitting element EL1 having a red (R) color, a first driving transistor DR1 that drives the first light-emitting element EL1, a first group of switching transistors SW11, SW12, and SW13 connected to the first driving transistor DR1, and a first storage capacitor Cst1.

The second pixel P2 may include a second light-emitting element EL2 having a white (W) color, a second driving transistor DR2 that drives the second light-emitting element EL2, a second group of switching transistors SW21, SW22, and SW23 connected to the second driving transistor DR2, and a second storage capacitor Cst2.

The third pixel P3 may include a third light-emitting element EL3 having a blue (B) color, a third driving transistor DR3 that drives the third light-emitting element EL3, a third group of switching transistors SW31, SW32, and SW33 connected to the third driving transistor DR3, and a third storage capacitor Cst3.

The fourth pixel P4 may include a fourth light-emitting element EL4 having a green (G) color, a fourth driving transistor DR4 that drives the fourth light-emitting element EL4, a fourth group of switching transistors SW41, SW42, and SW43 connected to the fourth driving transistor DR4, and a fourth storage capacitor Cst4.

Since the first group of switching transistors SW11, SW12, and SW13, the second group of switching transistors SW21, SW22, and SW23, the third group of switching transistors SW31, SW32, and SW33, and the fourth group of switching transistors SW41, SW42, and SW43 are connected to the four gate lines GL1 to GL4, the number of gate lines necessary for time division driving in DRD internal compensation can be reduced.

The first pixel P1 and the third pixel P3 are connected to different data lines DL1 and DL2 and thus do not require time division driving therebetween and can be connected to the same gate lines GL1, GL3, and GL4. Likewise, the second pixel P2 and the fourth pixel P4 are connected to different data lines DL1 and DL2 and thus do not require time division driving therebetween and can be connected to the same gate lines GL2, GL3, and GL4.

The first gate line GL1 is connected to the first and third pixels P1 and P3 to supply a first gate control signal SC1,3 to the first and third pixels P1 and P3, and the second gate line GL2 is connected to the second and fourth pixels P2 and P4 to supply a second gate control signal SC2,4 to the second and fourth pixels P2 and P4. The third gate line GL3 is commonly connected to the first to fourth pixels P1 to P4 to supply a third gate control signal SE1,2,3,4 to the first to fourth pixels P1 to P4. In addition, the fourth gate line GL4 is commonly connected to the first to fourth pixels P1 to P4 to supply a fourth gate control signal INI1,2,3,4 to the first to fourth pixels P1 to P4.

The first gate control signal SC1,3 corresponds to a first data voltage Vdata_P1 to be supplied to the first pixel P1 and corresponds to a third data voltage Vdata_P3 to be supplied to the third pixel P3. The second gate control signal SC2,4 corresponds to a second data voltage Vdata_P2 to be supplied to the second pixel P2 and corresponds to a fourth data voltage Vdata_P4 to be supplied to the fourth pixel P4. The third gate control signal SE1,2,3,4 corresponds to the reference voltage REF to be commonly supplied to the first to fourth pixels P1 to P4, and the fourth gate control signal INI1,2,3,4 corresponds to the initialization voltage INIT to be commonly supplied to the first to fourth pixels P1 to P4.

Figure 12:
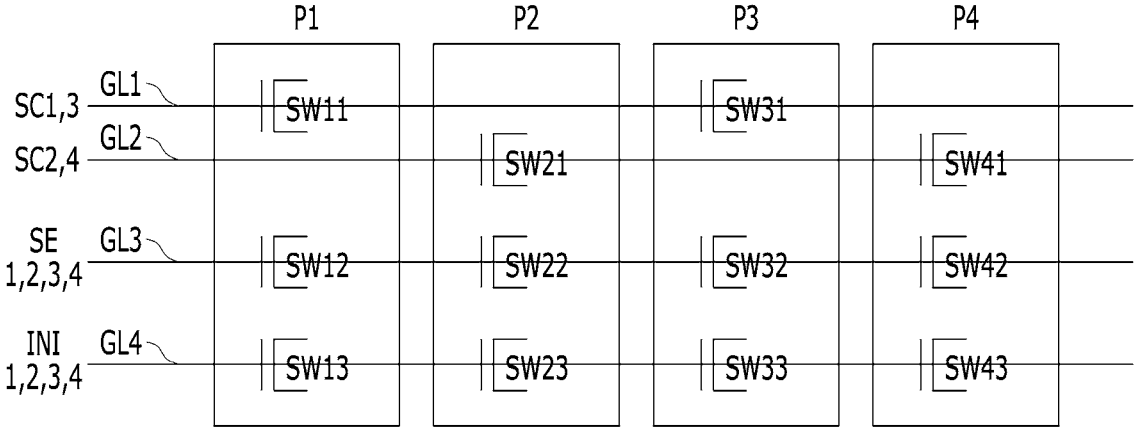

Referring to FIG. 12, the switching transistors SW11 and SW31 are simultaneously switched on or off in response to the first gate control signal SC1,3. The switching transistors SW21 and SW41 are simultaneously switched on or off in response to the second gate control signal SC2,4. The switching transistors SW12, SW22, SW32, and SW42 are simultaneously switched on or off in response to the third gate control signal SE1,2,3,4. The switching transistors SW13, SW23, SW33, and SW43 are simultaneously switched on or off in response to the fourth gate control signal INI1,2,3,4.

In this manner, the first and second gate control signals SC1,3 and SC2,4 may be separately supplied to the first to fourth pixels P1 to P4 through two gate lines, the third gate control signal SE1,2,3,4 may be supplied to the first to fourth pixels P1 to P4 through a single gate line, and the fourth gate control signal INI1,2,3,4 may be supplied to the first to fourth pixels P1 to P4 through a single gate line. As a result, the number of gate lines necessary for DRD internal compensation of the pixels disposed on one pixel lines can be reduced from six to four.

A configuration of connections between the four gate lines GL1 to GL4, and the switching transistors, and the driving transistors in the first and second pixels P1 and P2 is substantially the same as that described in FIG. 5 and FIG. 6 and thus description thereof is omitted. In addition, a configuration of connections between the four gate lines GL1 to GL4, and the switching transistors, and the driving transistors in the third and fourth pixels P3 and P4 is similar to that described in FIG. 5 and FIG. 6 and thus description thereof is omitted.

Figure 13:
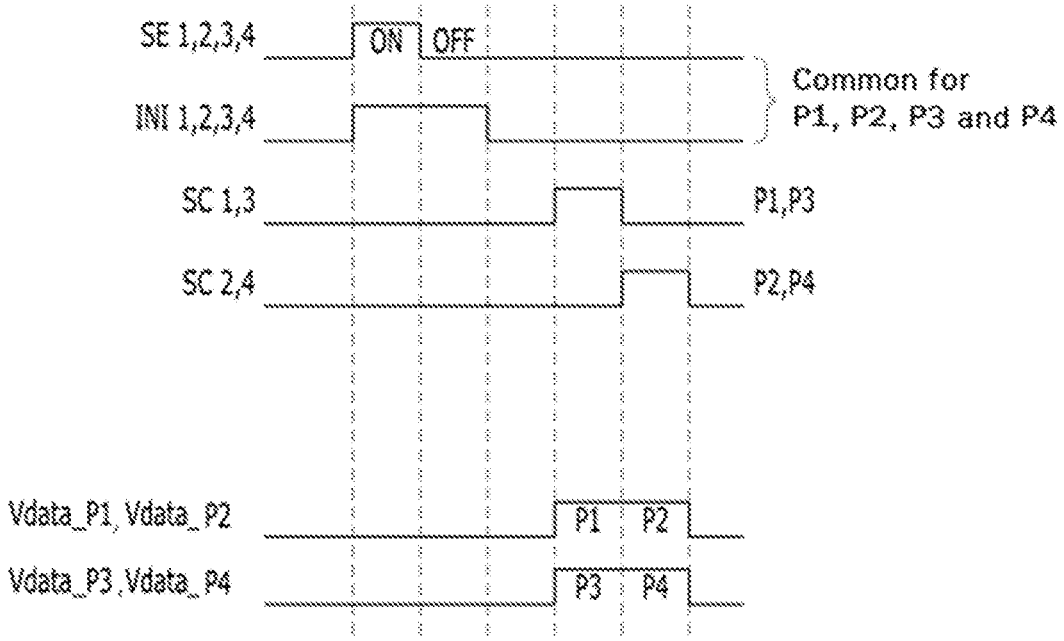

FIG. 13 shows driving timings of the first to fourth pixels P1 to P4 and differs from FIG. 8 in that i) the first and third pixels P1 and P3 simultaneously operate according to the first gate control signal SC1,3, ii) the second and fourth pixels P2 and P4 simultaneously operate according to the second gate control signal SC2,4, iii) the first to fourth pixels P1 to P4 simultaneously operate according to the third gate control signal SE1,2,3,4, and iv) the first to fourth pixels P1 to P4 simultaneously operate according to the fourth gate control signal INI1,2,3,4. In FIG. 13, driving timing configuration other than i), ii), iii), and iv) is substantially the same as that of FIG. 8.

Second Embodiment

Figure 14:
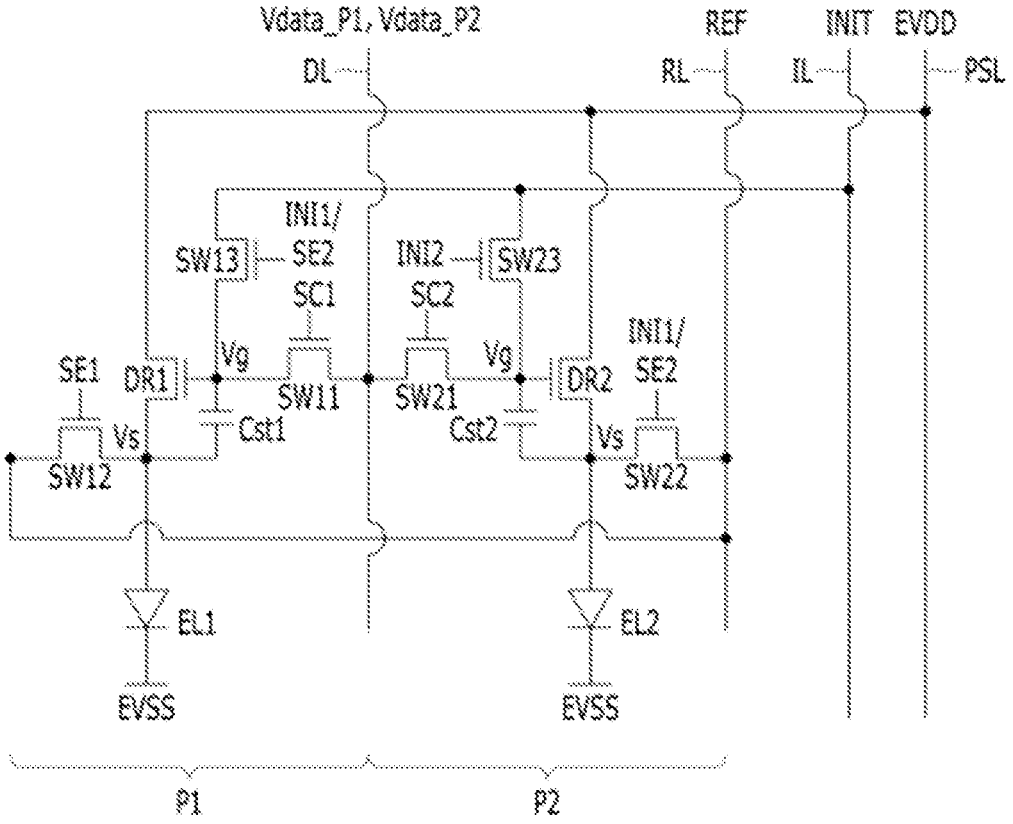
FIG. 14 to FIG. 16 are diagrams showing configurations of connections between two pixels and signal lines according to a second embodiment of the present disclosure.
Figure 15:
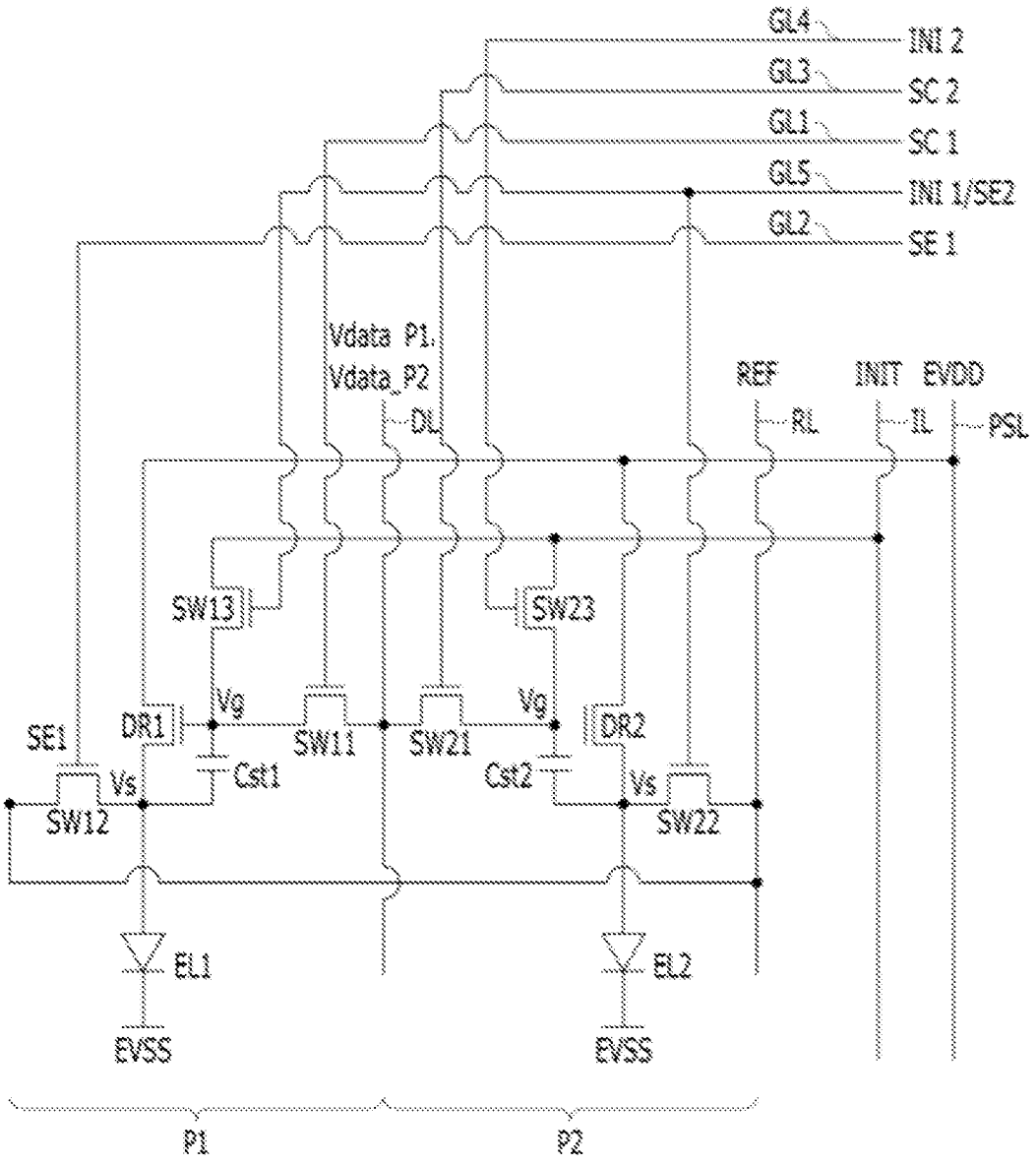
Figure 16:
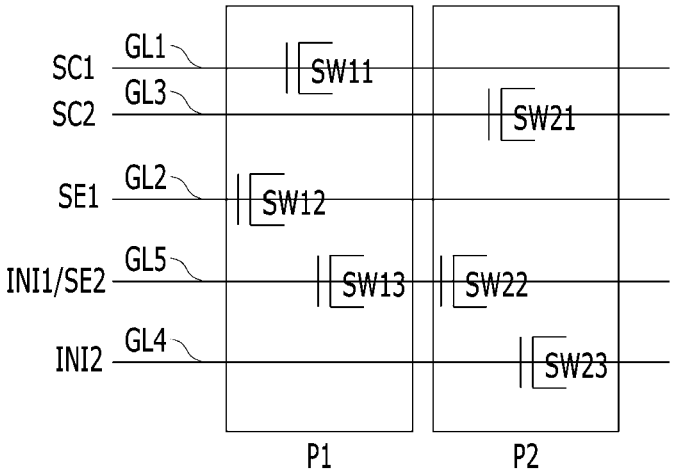

FIG. 14 to FIG. 16 are diagrams showing configurations of connections between two pixels and signal lines according to a second embodiment of the present disclosure.

Referring to FIG. 14 and FIG. 15, two pixels P1 and P2 according to the second embodiment are contiguously disposed in the horizontal direction having a data line DL interposed therebetween and share the data line DL to be driven in a time division manner for DRD internal compensation.

The first pixel P1 may include a first light-emitting element EL1 having a first color, a first driving transistor DR1 that drives the first light-emitting element EL1, a first group of switching transistors SW11, SW12, and SW13 connected to the first driving transistor DR1, and a first storage capacitor Cst1 and may operate through a method similar to that described above with reference to FIG. 3 to FIG. 4E.

The second pixel P2 may include a second light-emitting element EL2 having a second color, a second driving transistor DR2 that drives the second light-emitting element EL2, a second group of switching transistors SW21, SW22, and SW23 connected to the second driving transistor DR2, and a second storage capacitor Cst2 and may operate through a method similar to that described above with reference to FIG. 3 to FIG. 4E.

For time division driving, a case in which the first group of switching transistors SW11, SW12, and SW13 and the second group of switching transistors SW21, SW22, and SW23 are connected to different gate lines (i.e., six gate lines) may be considered. However, in this case, the number of gate lines is considerably greater than that in a non-DRD type in which the first group of switching transistors SW11, SW12, and SW13 and the second group of switching transistors SW21, SW22, and SW23 are connected to three gate lines (i.e., SW11 and S21 are connected to a first gate line, SW12 and SW22 are connected to a second gate line, and SW13 and SW23 are connected to a third gate line).

Accordingly, the second embodiment proposes a method of connecting the first group of switching transistors SW11, SW12, and SW13 and the second group of switching transistors SW21, SW22, and SW23 to five gate lines GL1 to GL5 in an electroluminescent display device for time division driving.

To this end, the first gate line GL1 is connected to the first pixel P1 to supply a first gate control signal SC1 to the first pixel P1, and the second gate line GL2 is connected to the first pixel P1 to supply a second gate control signal SE1 to the first pixel P1. The third gate line GL3 is connected to the second pixel P2 to supply a third gate control signal SC2 to the second pixel P2, and the fourth gate line GL4 is connected to the second pixel P2 to supply a fourth gate control signal INI2 to the second pixel P2. In addition, the fifth gate line GL5 is commonly connected to the first and second pixels P1 and P2 to supply a fifth gate control signal INI1/SE2 to the first and second pixels P1 and P2.

The first gate control signal SC1 corresponds to a first data voltage Vdata_P1 to be supplied to the first pixel P1, and the second gate control signal SE1 corresponds to a reference voltage REF to be supplied to the first pixel P1. The third gate control signal SC2 corresponds to a second data voltage Vdata_P2 to be supplied to the second pixel P2, and the fourth gate control signal INI2 corresponds to the initialization voltage INIT to be supplied to the second pixel P2. In addition, the fifth gate control signal INI1, SE2 corresponds to the initialization voltage INIT to be supplied to the first pixel P1 and corresponds to the reference voltage REF to be supplied to the second pixel P2.

Since the first data voltage Vdata_P1 and the second data voltage Vdata_P2 need to be distributed to the first pixel P1 and the second pixel P2 through the same data line DL, pixel writing timings of the first data voltage Vdata_P1 and the second data voltage Vdata_P2 need to be temporally separated. If not, the first data voltage Vdata_P1 and the second data voltage Vdata_P2 may be mixed, causing image distortion.

On the other hand, the reference voltage REF is a first common voltage applied to the first pixel P1 and the second pixel P2 at the same level and the initialization voltage INIT is also a second common voltage applied to the first pixel P1 and the second pixel P2 at the same level, and thus the reference voltage REF and the initialization voltage INIT may be simultaneously supplied to the first pixel P1 and the second pixel P2 as described above with reference to FIG. 5 to FIG. 8. In this case, however, compensation variation may occur due to a floating time difference between the two pixels P1 and P2, and thus the second embodiment proposes DRD internal compensation that does not cause compensation variation.

Referring to FIG. 16, in the second embodiment, the first and third gate control signals SC1 and SC2 synchronized with supply timings of the first and second data voltages Vdata_P1 and Vdata_P2 are temporally separated and selectively supplied to the first and second pixels P1 and P2, the second gate control signal SE1 synchronized with a first supply timing of the reference voltage REF is supplied to the first pixel P1, and the fourth gate control signal INI2 synchronized with a second supply timing of the initialization voltage INIT is supplied to the second pixel P2 for DRD internal compensation. In addition, the fifth gate control signal INI1,SE2 synchronized with a second supply timing of the reference voltage REF and a first supply timing of the initialization voltage INIT is commonly supplied to the first and second pixels P1 and P2 in the second embodiment. Accordingly, it is possible to reduce the number of gate lines necessary for DRD internal compensation of pixels disposed on one pixel line from six to five in the second embodiment.

A configuration of connections between the five gate lines GL1 to GL5, and switching transistors and driving transistors in the first and second pixels P1 and P2 will be described in more detail below.

The first group of switching transistors SW11, SW12, and SW13 includes the first switching transistor SW11 that operates according to the first gate control signal SC1 from the first gate line GL1 to connect the gate of the first driving transistor DR1 to the data line DL, the second switching transistor SW12 that operates according to the second gate control signal SE1 from the second gate line GL2 to connect the source of the first driving transistor DR1 to the reference voltage line RL, and the third switching transistor SW13 that operates according to the fifth gate control signal INI1,SE2 from the fifth gate line GL5 to connect the gate of the first driving transistor DR1 to the initialization voltage line IL.

The second group of switching transistors SW21, SW22, and SW23 includes the fourth switching transistor SW21 that operates according to the third gate control signal SC2 from the third gate line GL3 to connect the gate of the second driving transistor DR2 to the data line DL, the fifth switching transistor SW22 that operates according to the fifth gate control signal INI1/SE2 from the fifth gate line GL5 to connect the source of the second driving transistor DR2 to the reference voltage line RL, and the sixth switching transistor SW23 that operates according to the fourth gate control signal INI2 from the fourth gate line GL4 to connect the gate of the second driving transistor DR2 to the initialization voltage line IL.

The first to fifth gate lines GL1 to GL5 are connected to the gate driver (13 in FIG. 1), the data line DL and the reference voltage line RL are connected to the data driver (12 in FIG. 1), and the initialization voltage line IL is connected to the power supply circuit.

The gate driver 13 generates the first gate control signal SC1, supplies the first gate control signal SC1 to the first gate line GL1, generates the second gate control signal SE1, supplies the second gate control signal SE1 to the second gate line GL2, generates the third gate control signal SC2, supplies the third gate control signal SC2 to the third gate line GL3, generates the fourth gate control signal INI2, supplies the fourth gate control signal INI2 to the fourth gate line GL4, generates the fifth gate control signal INI1,SE2, and supplies the fifth gate control signal INI1,SE2 to the fifth gate line GL5. The data driver 12 supplies the first data voltage Vdata_P1 to be supplied to the first pixel P1 to the data line DL in synchronization with the first gate control signal SC1 at an on level, supplies the second data voltage Vdata_P2 to be supplied to the second pixel P2 to the data line DL in synchronization with the third gate control signal SC2 at the on level, supplies the reference voltage REF to be supplied to the first pixel P1 to the reference voltage line RL in synchronization with the second gate control signal SE1 at the on level, and supplies the reference voltage REF to be supplied to the second pixel P2 to the reference voltage line RL in synchronization with the fifth gate control signal INI1/SE2 at the on level. In addition, the power supply circuit supplies the initialization voltage INIT to be supplied to the first pixel P1 to the initialization voltage line IL in synchronization with the fifth gate control signal INI1,SE2 at the on level and supplies the initialization voltage INIT to be supplied to the second pixel P2 to the initialization voltage line IL in synchronization with the fourth gate control signal INI2 at the on level.

Figure 17:
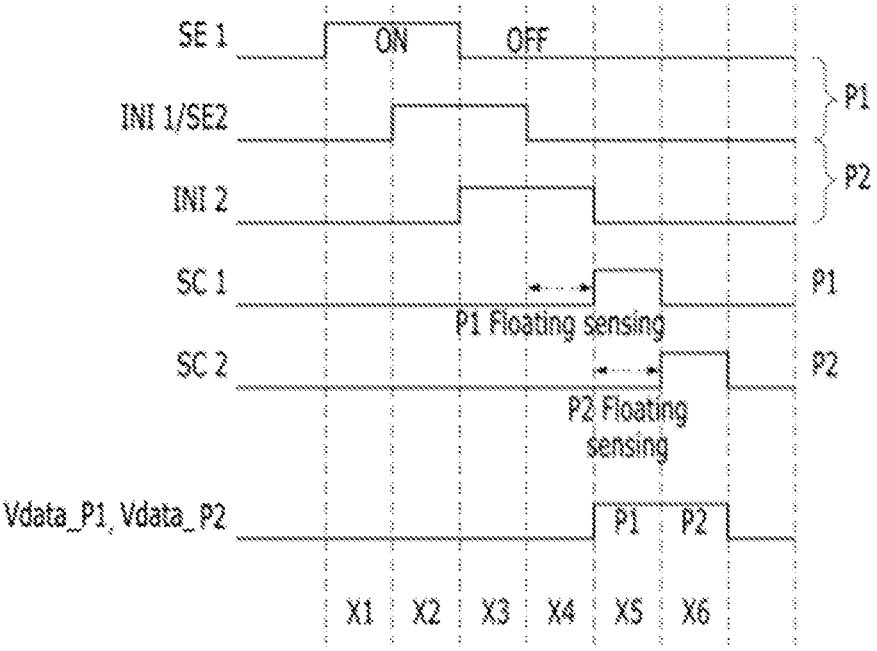
FIG. 17 is a diagram showing driving timings of two pixels according to the second embodiment.

FIG. 17 is a diagram showing driving timings of the two pixels P1 and P2 according to the second embodiment.

Referring to FIG. 17, driving timings for the first and second pixels P1 and P2 may include first to sixth periods X1 to X6. The first period X1, the second period X2, the third period X3, the fourth period X4, the fifth period X5, and the sixth period X6 may be sequentially provided at a specific interval, for example, one horizontal period interval.

In the first to sixth periods X1 to X6, the first and third gate control signals SC1 and SC2 may have the same pulse width while having different pulse phases. In addition, the second, fourth, and fifth gate control signals SE1, INI2, INI1/SE2 may have a pulse width twice that of the first and third gate control signals SC1 and SC2. In this manner, any of the pulse width and the pulse phase of each of the first to fifth gate control signals SC1, SE1, SC2, INI2, and INI1/SE2 is designed to be different from that of the remaining four gate control signals to allow internal compensation operation and to contribute to a simple operation scheme of the gate driver.

All of the first to fifth gate control signals SC1, SE1, SC2, INI2, and INI1/SE2 swing between an on level ON and an off level OFF and have the same pulse amplitude. The second gate control signal SE1 has the on level ON only in the first and second periods X1 and X2, the fifth gate control signal INI1/SE2 has the on level ON only in the second and third periods X2 and X3, the fourth gate control signal INI2 has the on level ON only in the third and fourth periods X3 and X4, the first gate control signal SC1 has the on level ON only in the fifth period X, and the third gate control signal SC2 has the on level ON only in the sixth period X6. The DRD internal compensation operation can also be smoothly performed in a state in which the number of gate lines is reduced according to such timing settings for the first to fifth gate control signals SC1, SE1, SC2, INI2, and INI1/SE2.

In the first to sixth periods X1 to X6, operations of the first and second pixels P1 and P2 for DRD internal compensation operation are substantially the same as those described in FIG. 4A to FIG. 4E. Since floating sensing periods of the first pixel P1 and the second pixel P2 have the same duration according to timing settings for the first to fifth gate control signals SC1, SE1, SC2, INI2, and INI1/SE2 as described in FIG. 17, DRD internal compensation that does not cause internal compensation variation can be realized.

Meanwhile, for normal internal compensation operation, the reference voltage REF needs to be applied to the first and second pixels P1 and P2 at the same level, and the initialization voltage INIT needs to be applied to the first and second pixels P1 and P2 at the same level. To this end, an on switching period of the second switching transistor SW12 for supplying the reference voltage REF to the first pixel P1 needs to be identical to an on switching period of the fifth switching transistor SW22 for supplying the reference voltage REF to the second pixel P2. Further, an on switching period of the third switching transistor SW13 for supplying the initialization voltage INIT to the first pixel P1 needs to be identical to an on switching period of the sixth switching transistor SW23 for supplying the initialization voltage INIT to the second pixel P2.

The on switching period of the second switching transistor SW12 is determined according to the second gate control signal SE1 supplied through the second gate line GL2, and the on switching period of the fifth switching transistor SW22 is determined according to the fifth gate control signal INI1,SE2 supplied through the fifth gate line GL5. In addition, the on switching period of the third switching transistor SW13 is determined according to the fifth gate control signal INI1,SE2 supplied through the fifth gate line GL5, and the on switching period of the sixth switching transistor SW23 is determined according to the fourth gate control signal INI2 supplied through the fourth gate line GL4.

In the first and second pixels P1 and P2, a single switching transistor is connected to the second gate line GL2 and a single switching transistor is connected to the fourth gate line GL4, whereas two switching transistors are connected to the fifth gate line GL5. In this manner, a load connected to the fifth gate line GL5 is relatively large, and thus an RC delay amount of the fifth gate control signal INI1,SE2 occurring in the fifth gate line GL5 is greater than an RC delay amount of the second gate control signal SE1 occurring in the second gate line GL2 or an RC delay amount of the fourth gate control signal INI2 occurring in the fourth gate line GL4. RC delay refers to delay of charging and/or discharging time of a signal line due to a resistance component and a capacitance component existing in the signal line. Rising/falling time of the fifth gate control signal INI1,SE2 may become relatively longer than that of the second gate control signal SE1 or the fourth gate control signal INI2 due to an RC delay amount difference. Accordingly, an on level duration of the fifth gate control signal INI1,SE2 may differ from that of the second gate control signal SE1 or the fourth gate control signal INI2.

To prevent such side effects, the line width of the fifth gate line GL5 may be designed to be different from those of the second and fourth gate lines GL2 and GL4. Since the load connected to the fifth gate line GL5 is larger than those connected to the second and fourth gate lines GL2 and GL4, the line width of the fifth gate line GL5 may be designed to be greater than those of the second and fourth gate lines GL2 and GL4. When a second line width of the fifth gate line GL5 is designed to be greater than a first line width of the second and fourth gate lines GL2 and GL4, RC delay amount variation in the second, fourth, and fifth gate lines GL2, GL4, and GL5 can be reduced or minimized, and thus internal compensation uniformity in the first and second pixels P1 and P2 can be secured.

FIG. 18 to FIG. 21 are diagrams showing examples in which the second embodiment of the present disclosure is applied to one unit pixel consisting of four pixels.

Figure 18:
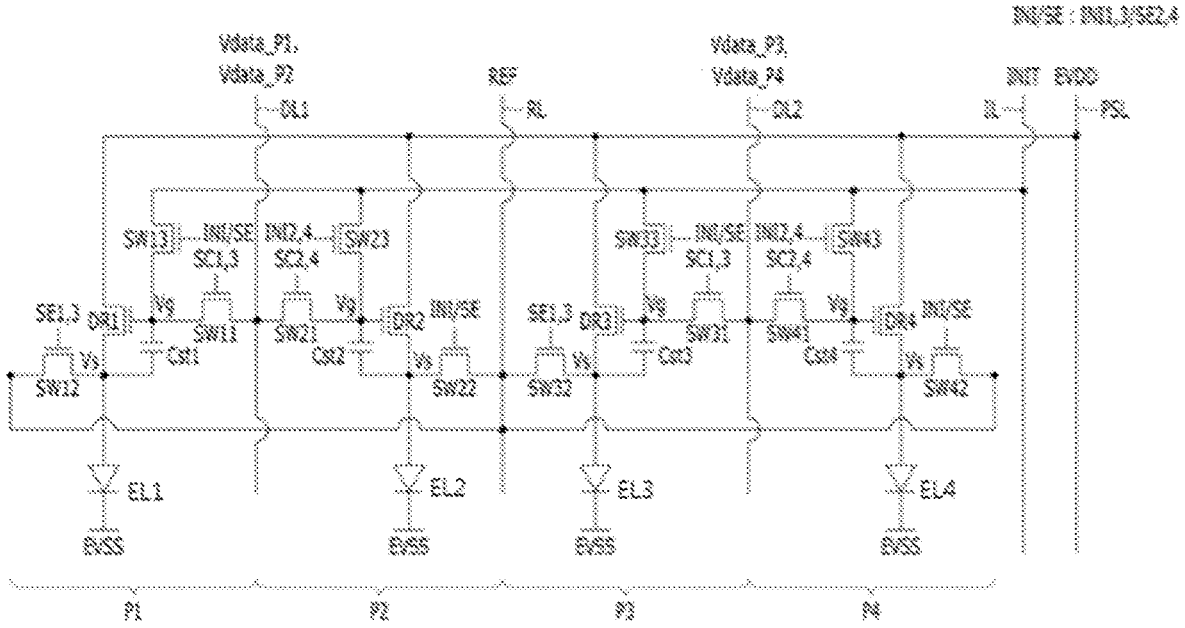
FIG. 18 to FIG. 21 are diagrams showing examples in which the second embodiment of the present disclosure is applied to one unit pixel consisting of four pixels.
Figure 19:
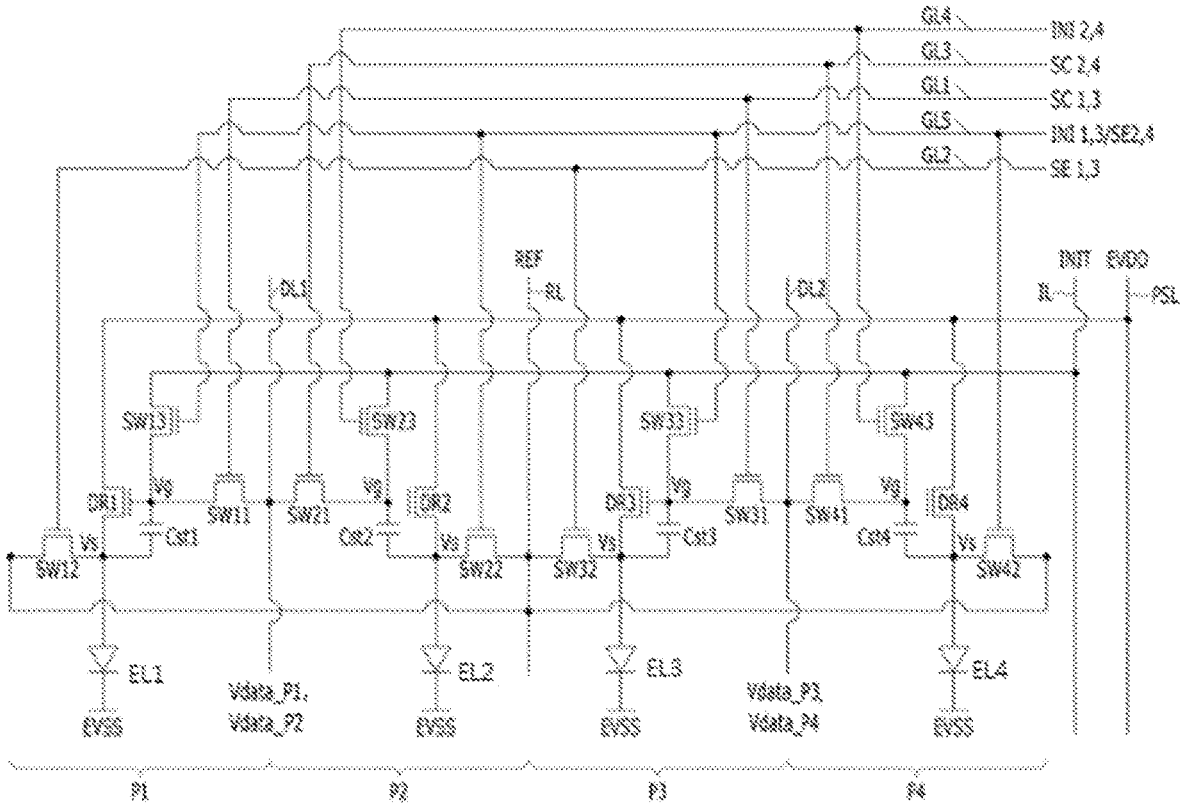

Referring to FIG. 18 and FIG. 19, one unit pixel includes first to fourth pixels P1 to P4 contiguously disposed in the horizontal direction and sharing one reference voltage line RL. The first and second pixels P1 and P2 are contiguously disposed having a first data line DL1 interposed therebetween and share the first data line DL1 to be driven in a time division manner. In addition, the third and fourth pixels P3 and P4 are contiguously disposed having a second data line DL2 interposed therebetween and share the second data line DL2 to be driven in a time division manner.

The first pixel P1 may include a first light-emitting element EL1 having a red (R) color, a first driving transistor DR1 that drives the first light-emitting element EL1, a first group of switching transistors SW11, SW12, and SW13 connected to the first driving transistor DR1, and a first storage capacitor Cst1.

The second pixel P2 may include a second light-emitting element EL2 having a white (W) color, a second driving transistor DR2 that drives the second light-emitting element EL2, a second group of switching transistors SW21, SW22, and SW23 connected to the second driving transistor DR2, and a second storage capacitor Cst2.

The third pixel P3 may include a third light-emitting element EL3 having a blue (B) color, a third driving transistor DR3 that drives the third light-emitting element EL3, a third group of switching transistors SW31, SW32, and SW33 connected to the third driving transistor DR3, and a third storage capacitor Cst3.

The fourth pixel P4 may include a fourth light-emitting element EL4 having a green (G) color, a fourth driving transistor DR4 that drives the fourth light-emitting element EL4, a fourth group of switching transistors SW41, SW42, and SW43 connected to the fourth driving transistor DR4, and a fourth storage capacitor Cst4.

Since the first group of switching transistors SW11, SW12, and SW13, the second group of switching transistors SW21, SW22, and SW23, the third group of switching transistors SW31, SW32, and SW33, and the fourth group of switching transistors SW41, SW42, and SW43 are connected to the five gate lines GL1 to GL5, the number of gate lines necessary for time division driving in DRD internal compensation can be reduced.

The first pixel P1 and the third pixel P3 are connected to different data lines DL1 and DL2 and thus do not require time division driving therebetween and can be connected to the same gate lines GL1, GL2, and GL5. Likewise, the second pixel P2 and the fourth pixel P4 are connected to different data lines DL1 and DL2 and thus do not require time division driving therebetween and can be connected to the same gate lines GL3, GL4, and GL5.

The first gate line GL1 is connected to the first and third pixels P1 and P3 to supply a first gate control signal SC1,3 to the first and third pixels P1 and P3, and the second gate line GL2 is connected to the first and third pixels P1 and P3 to supply a second gate control signal SE1,3 to the first and third pixels P1 and P3. The third gate line GL3 is connected to the second and fourth pixels P2 and P4 to supply a third gate control signal SC2,4 to the second and fourth pixels P2 and P4, and the fourth gate line GL4 is connected to the second and fourth pixels P2 and P4 to supply a fourth gate control signal INI2,4 to the second and fourth pixels P2 and P4. In addition, the fifth gate line GL5 is commonly connected to the first to fourth pixels P1 to P4 to supply a fifth gate control signal INI1,3/SE2,4 to the first to fourth pixels P1 to P4.

The first gate control signal SC1,3 corresponds to a first data voltage Vdata_P1 to be supplied to the first pixel P1 and corresponds to a third data voltage Vdata_P3 to be supplied to the third pixel P3. The second gate control signal SE1,3 corresponds to the reference voltage REF to be supplied to the first pixel P1 and corresponds to the reference voltage REF to be supplied to the third pixel P3. The third gate control signal SC2,4 corresponds to a second data voltage Vdata_P2 to be supplied to the second pixel P2 and corresponds to a fourth data voltage Vdata_P4 to be supplied to the fourth pixel P4. The fourth gate control signal INI2,4 corresponds to the initialization voltage INIT to be supplied to the second pixel P2 and corresponds to the initialization voltage INIT to be supplied to the fourth pixel P4. In addition, the fifth gate control signal INI1,3/SE2,4 corresponds to the initialization voltage INIT to be supplied to the first and third pixels P1 and P3 and corresponds to the reference voltage REF to be supplied to the second and fourth pixels P2 and P4.

Figure 20:
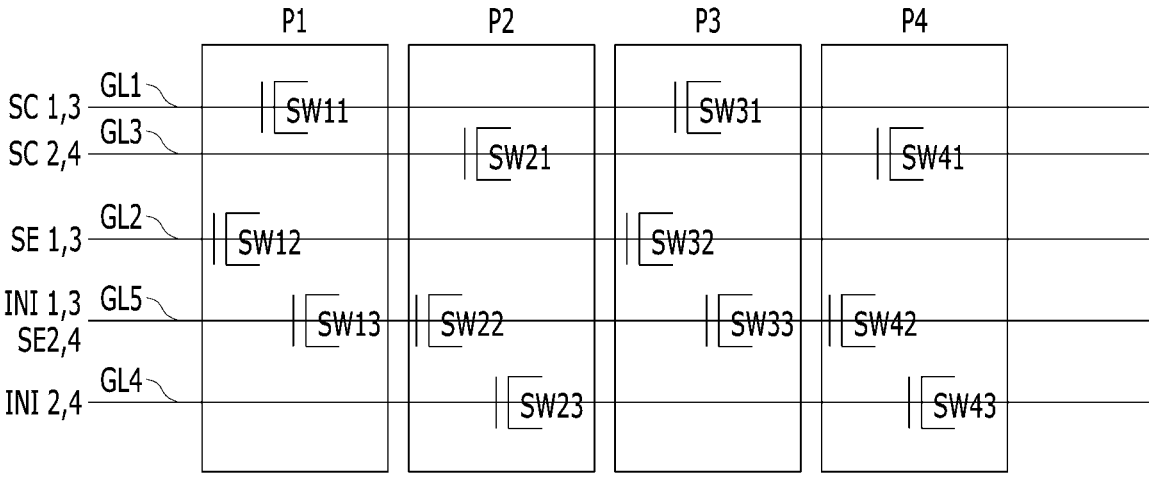

Referring to FIG. 20, the switching transistors SW11 and SW31 are simultaneously switched on or off in response to the first gate control signal SC1,3. The switching transistors SW12 and SW32 are simultaneously switched on or off in response to the second gate control signal SE1,3. The switching transistors SW21 and SW41 are simultaneously switched on or off in response to the third gate control signal SC2,4. The switching transistors SW23 and SW43 are simultaneously switched on or off in response to the fourth gate control signal INI2,4. In addition, the switching transistors SW13, SW33, SW22, and SW42 are simultaneously switched on or off in response to the fifth gate control signal INI1,3/SE2,4.

According to such a configuration, the number of gate lines necessary for DRD internal compensation of the pixels disposed on one pixel line can be reduced from six to five.

A configuration of connections between the five gate lines GL1 to GL5, and switching transistors, and driving transistors in the first and second pixels P1 and P2 is similar to those described in FIG. 14 and FIG. 15 and thus description thereof is omitted. Further, a configuration of connections between the five gate lines GL1 to GL5, and switching transistors, and driving transistors in the third and fourth pixels P3 and P4 is similar to those described in FIG. 14 and FIG. 15 and thus description thereof is omitted.

Figure 21:
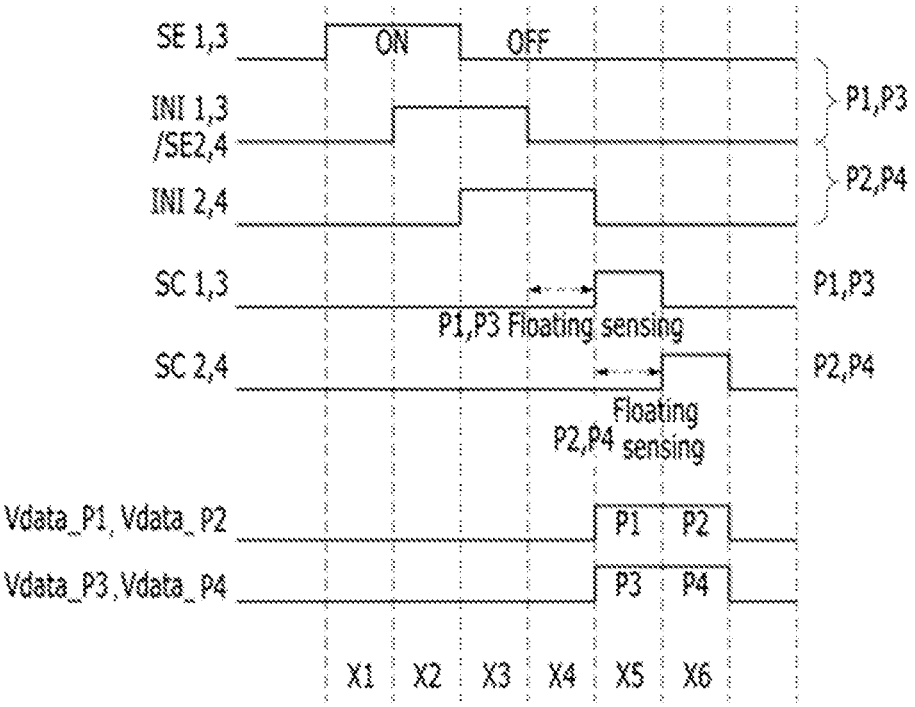

FIG. 21 shows driving timings of the first to fourth pixels P1 to P4 and differs from FIG. 17 in that i) the first and third pixels P1 and P3 simultaneously operate according to the first gate control signal SC1,3, ii) the first and third pixels P1 and P3 simultaneously operate according to the second gate control signal SE1,3, iii) the second and fourth pixels P2 and P4 simultaneously operate according to the third gate control signal SC2,4, iv) the second and fourth pixels P2 and P4 simultaneously operate according to the fourth gate control signal INI2, 4, and v) the first to fourth pixels P1 to P4 simultaneously operate in response to the fifth gate control signal INI1,3/SE2,4. In FIG. 21, driving timing configuration other than i), ii), iii), iv), and v) is substantially the same as that of FIG. 17.

Third Embodiment

Figure 22:
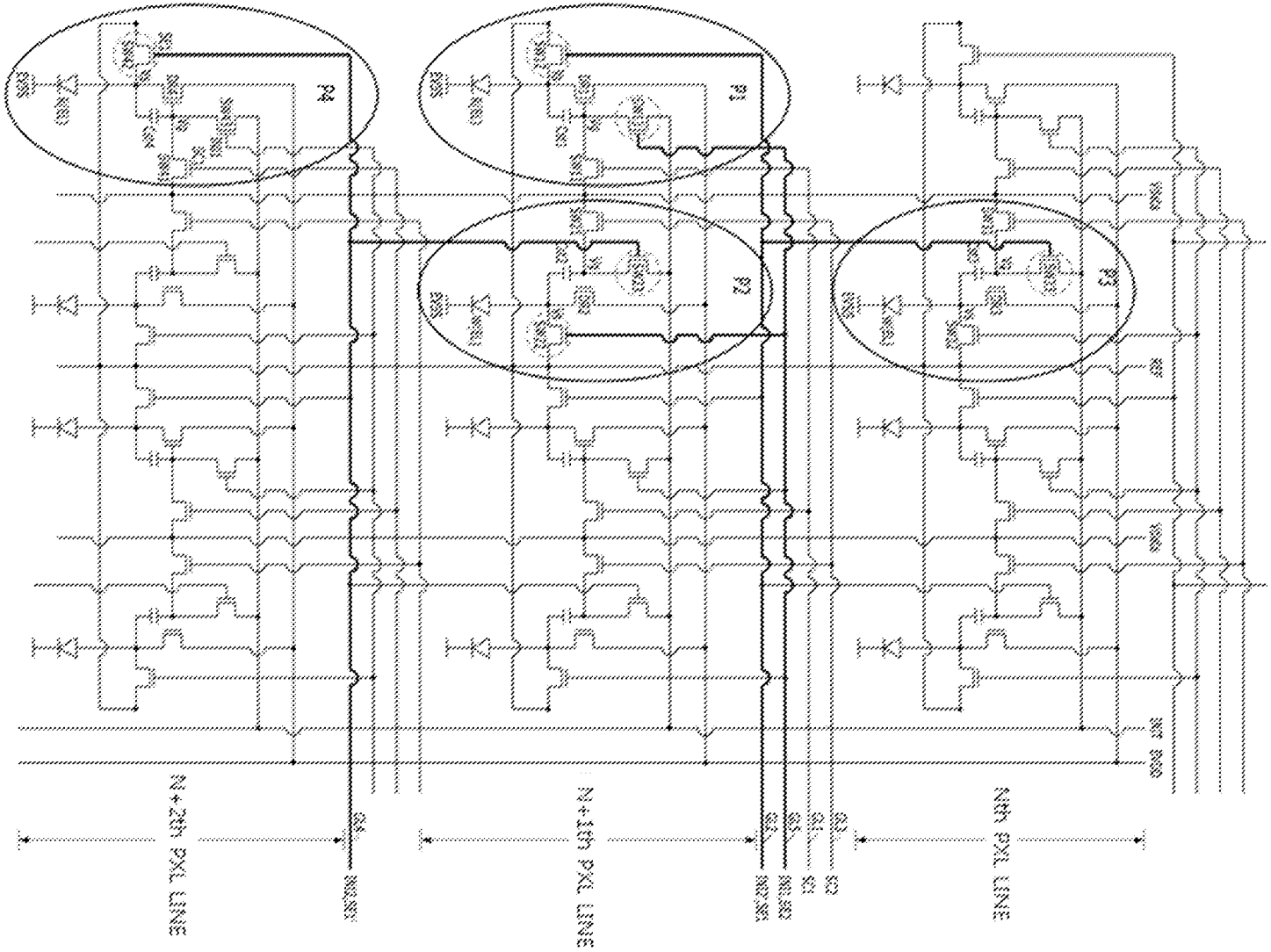
FIG. 22 is a diagram showing a configuration of connections between twelve pixels distributed and disposed in three pixel lines and signal lines according to a third embodiment of the present disclosure.

FIG. 22 is a diagram showing a configuration of connections between four pixels distributed and disposed in each of three pixel lines and signal lines according to a third embodiment of the present disclosure.

Referring to FIG. 22, in the third embodiment, the number of gate lines necessary for DRD internal compensation is reduced through a configuration in which four pixels P1 to P4 that neighbor each other in the horizontal and vertical directions are connected to five gate lines.

The four pixels P1 to P4 include a first pixel P1, a second pixel P2, a third pixel P3, and a fourth pixel P4 that share the same data line. The first pixel P1 and the fourth pixel P4 may include a red light emitting element R (EL), and the second pixel P2 and the third pixel P3 may include a white light emitting element W (EL).

The first pixel P1 and the second pixel P2 are contiguously disposed in the horizontal direction having the data line interposed therebetween and additionally share a reference voltage line and an initialization voltage line. The first pixel P1 and the second pixel P2 may be disposed on an (n+1)-th pixel line. The first pixel P1 may be driven to receive a data voltage Vdata ahead of the second pixel P2.

The third pixel P3 is disposed adjacent to the second pixel P2 in a first vertical direction and additionally shares the reference voltage line and the initialization voltage line with the second pixel P2. The third pixel P3 may be disposed on an n-th pixel line. The third pixel P3 may be driven to receive the data voltage Vdata ahead of the first pixel P1.

The fourth pixel P4 is disposed adjacent to the first pixel P1 in a second vertical direction opposite the first vertical direction and additionally shares the reference voltage line and the initialization voltage line with the first pixel P1. The fourth pixel P4 may be disposed on an (n+2)-th pixel line. The fourth pixel P4 may be driven to receive the data voltage Vdata after the second pixel P2.

These four pixels P1 to P4 may be connected to five gate lines GL1 to GL5 to receive first to fifth gate control signals. The first gate line GL1 is connected to the first pixel P1 to supply the first gate control signal SC1 to the first pixel P1. The first gate control signal SC1 may be synchronized with a timing at which a first data voltage is supplied to the first pixel P1. The second gate line GL2 is connected to the first and third pixels P1 and P3 to supply the second gate control signal INI2',SE1 to the first and third pixels P1 and P3. The second gate control signal INI2',SE1 may be synchronized with a timing at which the reference voltage REF is supplied to the first pixel P1 and a timing at which the initialization voltage INIT is supplied to the third pixel P3. The third gate line GL3 is connected to the second pixel P2 to supply the third gate control signal SC2 to the second pixel P2. The third gate control signal SC2 may be synchronized with a timing at which a second data voltage is supplied to the second pixel P2. The fourth gate line GL4 is connected to the second and fourth pixels P2 and P4 to supply the fourth gate control signal INI2,SE1' to the second and fourth pixels P2 and P4. The fourth gate control signal INI2,SE1' may be synchronized with a timing at which the initialization voltage INIT is supplied to the second pixel P2 and a timing at which the reference voltage REF is supplied to the fourth pixel P4. The fifth gate line GL5 is connected to the first and second pixels P1 and P2 to supply the fifth gate control signal INI1,SE2 to the first and second pixels P1 and P2. The fifth gate control signal INI1,SE2 may be synchronized with a timing at which the initialization voltage INIT is supplied to the first pixel P1 and a timing at which the reference voltage REF is supplied to the second pixel P2.

Since the number of pixels connected to the second, fourth, and fifth gate lines GL2, GL4, and GL5 is greater than the number of pixels connected to the first and third gate lines GL1 and GL3, loads applied to the second, fourth, and fifth gate lines GL2, GL4, and GL5 are greater than loads applied to the first and third gate lines GL1 and GL3. To mitigate RC delay variation caused by differences between loads of gate lines, line widths of the gate lines may be designed depending on load magnitude. When the first and third gate lines GL1 and GL3 are designed in a first line width, the second, fourth, and fifth gate lines GL2, GL4, and GL5 may be designed in a second line width different from the first line width. Here, the second line width may be greater than the first line width.

Figure 23:
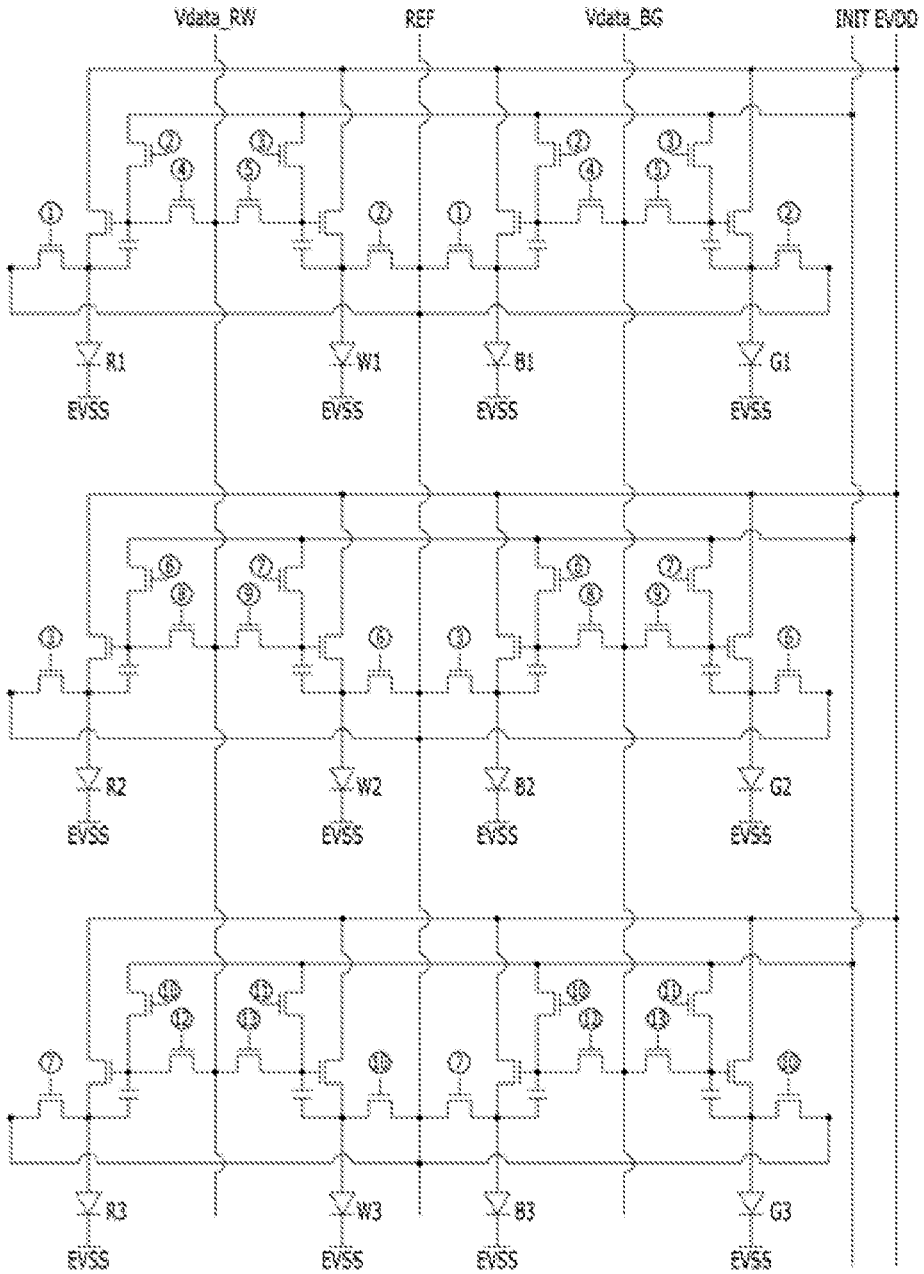
FIG. 23 and FIG. 24 are diagrams for describing driving timings for the twelve pixels distributed and disposed in the three pixel lines.
Figure 24:
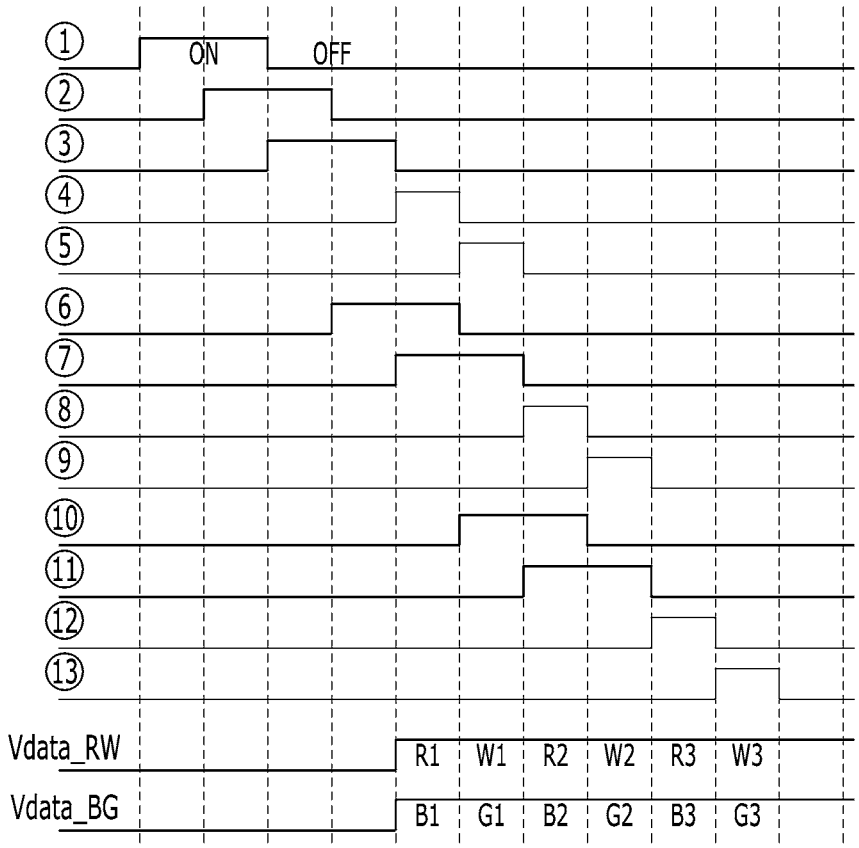

FIG. 23 and FIG. 24 are diagrams for describing driving timings for the twelve pixels distributed and disposed in the three pixel lines. In FIG. 23, R1, R2, R3, W1, W2, W3, B1, B2, B3, G1, G2, and G3 represent light-emitting elements included in the twelve pixels. Vdata_RW represents a data voltage to be provided to the pixels including the light-emitting elements R1, R2, R3, W1, W2, and W3, and Vdata_BG represents a data voltage to be provided to the pixels including the light-emitting elements B1, B2, B3, G1, G2, and G3.

Referring to FIG. 23 and FIG. 24, the twelve pixels share some gate lines while sharing the same data line in units of four pixels that neighbor in the horizontal and vertical directions as shown in FIG. 22. Consequently, the number of gate lines necessary to drive the twelve pixels through DRD internal compensation is reduced to 13. In FIG. 23 and FIG. 24, serial numbers indicate driving order of switching transistors belonging to the twelve pixels. The number of gate lines is identical to the number of serial numbers. When DRD internal compensation is realized through a conventional gate line non-sharing method, the number of gate lines necessary to drive twelve pixels is 18. Accordingly, the third embodiment can reduce the number of gate lines by 5 as compared to the conventional method.

As described above, the present embodiment can lessen panel design restriction and reduce a bezel size by reducing or minimizing increase in the number of gate lines in DRD internal compensation.

Furthermore, the present embodiment can improve accuracy and reliability of internal compensation by differently designing channel widths of driving elements or differently designing line widths of gate lines to reduce side effects caused by reduction in the number of gate lines in DRD internal compensation.

It will be appreciated by persons skilled in the art that the effects that can be achieved with the present disclosure are not limited to what has been particularly described hereinabove and other advantages of the present disclosure will be more clearly understood from the above detailed description.

Those skilled in the art will appreciate that various modifications and variations can be made in the present disclose without departing from the spirit or scope of the disclosure. Accordingly, the scope of the present disclosure should be determined by the appended claims and their legal equivalents, not by the above description.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electroluminescent display device, comprising:
a first pixel;
a second pixel sharing a data line, a reference voltage line, and an initialization voltage line with the first pixel and disposed adjoining the first pixel in a horizontal direction;
a first gate line coupled to the first pixel and provided to supply a first gate control signal to the first pixel;
a second gate line coupled to the second pixel and provided to supply a second gate control signal to the second pixel;
a third gate line commonly coupled to the first and second pixels and provided to supply a third gate control signal to the first and second pixels; and
a fourth gate line commonly coupled to the first and second pixels and provided to supply a fourth gate control signal to the first and second pixels,
wherein a channel width of a first driving element included in the first pixel differs from a channel width of a second driving element included in the second pixel.

2. The electroluminescent display device of claim 1, wherein the first pixel further includes a first light-emitting element driven by the first driving element to generate a light of a first color, a first group of switching elements coupled to the first driving element, and a first storage capacitor coupled to the first driving element, and
wherein the second pixel further includes a second light-emitting element driven by the second driving element to generate a light of a second color different from the first color, a second group of switching elements coupled to the second driving element, and a second storage capacitor coupled to the second driving element.

3. The electroluminescent display device of claim 2, wherein the first group of switching elements includes:
a first switching element configured to operate according to the first gate control signal to couple a gate of the first driving element to the data line;
a second switching element configured to operate according to the third gate control signal to couple a source of the first driving element to the reference voltage line; and
a third switching element configured to operate according to the fourth gate control signal to couple the gate of the first driving element to the initialization voltage line, and
the second group of switching elements includes:
a fourth switching element configured to operate according to the second gate control signal to couple a gate of the second driving element to the data line;
a fifth switching element configured to operate according to the third gate control signal to couple a source of the second driving element to the reference voltage line; and
a sixth switching element configured to operate according to the fourth gate control signal to couple the gate of the second driving element to the initialization voltage line.

4. The electroluminescent display device of claim 1, further comprising:
a gate driver coupled to the first to fourth gate lines;
a data driver coupled to the data line and the reference voltage line; and
a power supply circuit coupled to the initialization voltage line,
wherein the gate driver generates the first gate control signal, supplies the first gate control signal to the first gate line, generates the second gate control signal, supplies the second gate control signal to the second gate line, generates the third gate control signal, supplies the third gate control signal to the third gate line, generates the fourth gate control signal, and supplies the fourth gate control signal to the fourth gate line, wherein the data driver supplies a first data voltage to be supplied to the first pixel to the data line in synchronization with the first gate control signal at an on level, supplies a second data voltage to be supplied to the second pixel to the data line in synchronization with the second gate control signal at the on level, and supplies a reference voltage to be commonly supplied to the first and second pixels to the reference voltage line in synchronization with the third gate control signal at the on level, and the power supply circuit supplies an initialization voltage to be commonly supplied to the first and second pixels to the initialization voltage line in synchronization with the fourth gate control signal at the on level.

5. The electroluminescent display device of claim 1, wherein any of a pulse width and a pulse phase of each of the first to fourth gate control signals is different from that of the remaining three gate control signals in a first period, a second period, a third period, a fourth period, and a fifth period sequentially provided at a specific interval.

6. The electroluminescent display device of claim 5, wherein the third gate control signal has an on level only in the first period, the fourth gate control signal has the on level only in the first and second periods, the first gate control signal has the on level only in the fourth period, the second gate control signal has the on level only in the fifth period, and all of the first to fourth gate control signals have an off level in the third period.

7. The electroluminescent display device of claim 6, wherein the first pixel is floated in the third period and the second pixel is floated in the third and fourth periods.

8. The electroluminescent display device of claim 7, wherein the channel width of the first driving element has a first value in the first pixel, and the channel width of the second driving element has a second value less than the first value in the second pixel having a longer floating time than that of the first pixel.

9. An electroluminescent display device, comprising:

a first pixel;

a second pixel sharing a data line, a reference voltage line, and an initialization voltage line with the first pixel and disposed adjoining the first pixel in a horizontal direction;

a first gate line coupled to the first pixel and provided to supply a first gate control signal to the first pixel;

a second gate line coupled to the first pixel and provided to supply a second gate control signal to the first pixel;

a third gate line coupled to the second pixel and provided to supply a third gate control signal to the second pixel;

a fourth gate line coupled to the second pixel and provided to supply a fourth gate control signal to the second pixel; and a fifth gate line commonly coupled to the first and second pixels and provided to supply a fifth gate control signal to the first and second pixels, wherein the second and fourth gate lines have a first line width and the fifth gate line has a second line width different from the first line width.

10. The electroluminescent display device of claim 9, wherein the first pixel includes a first driving element, a first light-emitting element driven by the first driving element to generate a light a first color, a first group of switching elements coupled to the first driving element, and a first storage capacitor coupled to the first driving element, and wherein the second pixel includes a second driving element, a second light-emitting element driven by the first driving element to generate a light of a second color different from the first color, a second group of switching elements coupled to the second driving element, and a second storage capacitor coupled to the second driving element.

11. The electroluminescent display device of claim 10, wherein the first group of switching elements includes:

a first switching element configured to operate according to the first gate control signal to couple a gate of the first driving element to the data line;

a second switching element configured to operate according to the second gate control signal to couple a source of the first driving element to the reference voltage line; and a third switching element configured to operate according to the fifth gate control signal to couple the gate of the first driving element to the initialization voltage line, and the second group of switching elements includes:

a fourth switching element configured to operate according to the third gate control signal to couple a gate of the second driving element to the data line;

a fifth switching element configured to operate according to the fifth gate control signal to couple a source of the second driving element to the reference voltage line; and a sixth switching element configured to operate according to the fourth gate control signal to couple the gate of the second driving element to the initialization voltage line.

12. The electroluminescent display device of claim 9, further comprising:

a gate driver coupled to the first to fifth gate lines;

a data driver coupled to the data line; and a power supply circuit coupled to the initialization voltage line, wherein the gate driver generates the first gate control signal, supplies the first gate control signal to the first gate line, generates the second gate control signal, supplies the second gate control signal to the second gate line, generates the third gate control signal, supplies the third gate control signal to the third gate line, generates the fourth gate control signal, supplies the fourth gate control signal to the fourth gate line, generates the fifth gate control signal, and supplies the fifth gate control signal to the fifth gate line, the data driver supplies a first data voltage to be supplied to the first pixel to the data line in synchronization with the first gate control signal at an on level, supplies a second data voltage to be supplied to the second pixel to the data line in synchronization with the third gate control signal at the on level, supplies a reference voltage to be supplied to the first pixel to the reference voltage line in synchronization with the second gate control signal at the on level, and supplies the reference voltage to be supplied to the second pixel to the reference voltage line in synchronization with the fifth gate control signal at the on level, and the power supply circuit supplies an initialization voltage to be supplied to the first pixel to the initialization voltage line in synchronization with the fifth gate control signal at the on level.

13. The electroluminescent display device of claim 9, wherein any of a pulse width and a pulse phase of each of the first to fifth gate control signals is different from that of the remaining four gate control signals in a first period, a second period, a third period, a fourth period, a fifth period, and a sixth period sequentially provided at a specific interval.

14. The electroluminescent display device of claim 13, wherein the second gate control signal has an on level only in the first and second periods, the fifth gate control signal has the on level only in the second and third periods, the fourth gate control signal has the on level only in the third and fourth periods, the first gate control signal has the on level only in the fifth period, and the third gate control signal has an on level only in the sixth period.

15. The electroluminescent display device of claim 14, wherein the first pixel is floated in the fourth period and the second pixel is floated in the fifth period.

16. The electroluminescent display device of claim 9, wherein the second line width is greater than the first line width.

17. An electroluminescent display device, comprising:

a first pixel;

a second pixel sharing a data line provided to supply a data voltage, a reference voltage line provided to supply a reference voltage, and an initialization voltage line provided to supply an initialization voltage with the first pixel and disposed adjoining the first pixel in a horizontal direction;

a third pixel sharing the data line, the reference voltage line, and the initialization voltage line with the second pixel and disposed adjoining the second pixel in a first vertical direction to receive the data voltage ahead of the first pixel;

a fourth pixel sharing the data line, the reference voltage line, and the initialization voltage line with the first pixel and disposed adjoining the first pixel in a second vertical direction opposite the first vertical direction to receive the data voltage after the second pixel;

a first gate line coupled to the first pixel and provided to supply a first gate control signal to the first pixel;

a second gate line coupled to the first and third pixels and provided to supply a second gate control signal to the first and third pixels;

a third gate line coupled to the second pixel and provided to supply a third gate control signal to the second pixel;

a fourth gate line coupled to the second and fourth pixels and provided to supply a fourth gate control signal to the second and fourth pixels; and a fifth gate line commonly coupled to the first and second pixels and provided to supply a fifth gate control signal to the first and second pixels.

18. The electroluminescent display device of claim 17, wherein each of the first and third gate lines has a first line width and each of the second, fourth, and fifth gate lines has a second line width different from the first line width.

19. The electroluminescent display device of claim 18, wherein the second line width is greater than the first line width.

20. The electroluminescent display device of claim 17, wherein the third pixel is disposed in an n-th pixel line, the first and second pixels are disposed in an (n+1)-th pixel line, and the fourth pixel is disposed in an (n+2)-th pixel line, wherein n is a natural number greater than 0.

21. The electroluminescent display device of claim 17, wherein the first gate control signal is synchronized with a timing at which a first data voltage is supplied to the first pixel, the second gate control signal is synchronized with a timing at which the reference voltage is supplied to the first pixel and a timing at which the initialization voltage is supplied to the third pixel, the third gate control signal is synchronized with a timing at which a second data voltage is supplied to the second pixel, the fourth gate control signal is synchronized with a timing at which the initialization voltage is supplied to the second pixel and a timing at which the reference voltage is supplied to the fourth pixel, and the fifth gate control signal is synchronized with a timing at which the initialization voltage is supplied to the first pixel and a timing at which the reference voltage is supplied to the second pixel.

* * * * *